US010307648B2

(12) United States Patent
Boyd et al.

(10) Patent No.: US 10,307,648 B2
(45) **Date of Patent: *Jun. 4, 2019**

(54) GOLF CLUB HEAD OR OTHER BALL STRIKING DEVICE HAVING STIFFENED FACE PORTION

(71) Applicant: Karsten Manufacturing Corporation, Phoenix, AZ (US)

(72) Inventors: Robert M. Boyd, Flower Mound, TX (US); Jeremy N. Snyder, Benbrook, TX (US); Hiroshi Kawaguchi, Aliso Viejo, CA (US); James S. Thomas, Ft. Worth, TX (US); Raymond J. Sander, Benbrook, TX (US); Rick S. Wahlin, Keller, TX (US); Akira Shimozuuma, Niigata-Ken (JP)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/973,275

(22) Filed: May 7, 2018

(65) Prior Publication Data

US 2018/0250562 A1 Sep. 6, 2018

Related U.S. Application Data

(63) Continuation of application No. 14/497,826, filed on Sep. 26, 2014, now Pat. No. 9,999,811, which is a (Continued)

(51) Int. Cl.
*A63B 53/04* (2015.01)
*A63B 102/02* (2015.01)
(Continued)

(52) U.S. Cl.
CPC ..... *A63B 53/0466* (2013.01); *A63B 53/04* (2013.01); *A63B 53/047* (2013.01); (Continued)

(58) Field of Classification Search
CPC ... A63B 53/0466; A63B 53/04; A63B 53/047; A63B 2053/0412; A63B 2053/0416; (Continued)

(56) References Cited

U.S. PATENT DOCUMENTS 2,087,685 A 7/1937 Hackney
3,814,437 A 6/1974 Winquist
(Continued)

FOREIGN PATENT DOCUMENTS

JP 2003180887 7/2003

*Primary Examiner* — Sebastiano Passaniti

(57) ABSTRACT

A ball striking device, such as a golf club head, has a head that includes a face configured for striking a ball and a body connected to the face, the body being adapted for connection of a shaft proximate a heel thereof. The face has a thickened portion including an annular tapered area that tapers in thickness between an upper boundary and a lower boundary and encloses an elevated area bounded by the upper boundary. The upper and/or lower boundary defines a shape having two lobes, each with an outer edge with a convex profile, and a connecting portion extending between the lobes, such that the connecting portion is defined by two outer edges extending between the outer edges of the lobes, wherein at least one of the outer edges of the connecting portion has a concave outer profile.

23 Claims, 13 Drawing Sheets

Related U.S. Application Data continuation of application No. 13/211,961, filed on Aug. 17, 2011, now Pat. No. 8,845,454, which is a continuation-in-part of application No. 12/276,080, filed on Nov. 21, 2008, now Pat. No. 8,070,623.

(51) Int. Cl.
*A63B 102/18* (2015.01)
*A63B 102/20* (2015.01)
*A63B 102/22* (2015.01)
*A63B 102/24* (2015.01)

(52) U.S. Cl.
CPC . *A63B 2053/045* (2013.01); *A63B 2053/0408* (2013.01); *A63B 2053/0412* (2013.01); *A63B 2053/0416* (2013.01); *A63B 2053/0433* (2013.01); *A63B 2053/0458* (2013.01); *A63B 2053/0462* (2013.01); *A63B 2102/02* (2015.10); *A63B 2102/18* (2015.10); *A63B 2102/182* (2015.10); *A63B 2102/20* (2015.10); *A63B 2102/22* (2015.10); *A63B 2102/24* (2015.10)

(58) Field of Classification Search
CPC ..... A63B 2053/045; A63B 2053/0458; A63B 2053/0433; A63B 2053/0408; A63B 2053/0462
USPC ..... 473/324–350, 287–292
See application file for complete search history.

(56) References Cited

U.S. PATENT DOCUMENTS 4,511,145 A 4/1985 Schmidt
D318,703 S 7/1991 Shearer
5,028,049 A 7/1991 McKeighen
5,176,384 A 1/1993 Sala et al.
5,377,985 A 1/1995 Ohnishi
5,492,327 A 2/1996 Biafore
5,547,427 A 8/1996 Rigal et al.
5,586,947 A 12/1996 Hutin
5,595,552 A 1/1997 Wright et al.
5,669,829 A 9/1997 Lin
D386,550 S 11/1997 Wright et al.
D386,551 S 11/1997 Solheim et al.
D387,113 S 12/1997 Burrows
D387,405 S 12/1997 Solheim et al.
5,709,615 A 1/1998 Liang
5,711,722 A 1/1998 Miyajima et al.
5,718,641 A 2/1998 Lin
D400,945 S 11/1998 Gilbert et al.
5,908,357 A 6/1999 Hsieh
5,921,869 A 7/1999 Blough et al.
5,971,868 A 10/1999 Kosmatka
6,007,432 A 12/1999 Kosmatka
6,203,449 B1 3/2001 Kenmi
6,348,013 B1 2/2002 Kosmatka
6,454,665 B2 9/2002 Antonious
6,482,107 B1 11/2002 Urbanski et al.
6,595,057 B2 7/2003 Bissonnette et al.
6,652,391 B1 11/2003 Kubica et al.
6,780,123 B2 8/2004 Hasebe
6,800,039 B1 10/2004 Tseng
6,832,962 B2 12/2004 Stites et al.
6,840,872 B2 1/2005 Yoneyama
6,887,165 B2 5/2005 Tsurumaki
6,899,638 B2 5/2005 Iwata et al.
6,926,618 B2 8/2005 Sanchez et al.
7,169,059 B2 1/2007 Rice et al.
7,220,190 B2 5/2007 Hirano
7,294,064 B2 11/2007 Tsurumaki
7,387,579 B2 6/2008 Lin et al.
7,431,664 B2 10/2008 Meyer et al.
7,435,189 B2 10/2008 Hirano
7,442,132 B2 10/2008 Nishio
7,494,426 B2 2/2009 Nishio et al.
7,520,819 B2 4/2009 Rice et al.
7,549,935 B2 6/2009 Foster et al.
7,575,524 B2 8/2009 Willet et al.
7,614,964 B2 11/2009 Matsunaga
7,618,331 B2 11/2009 Hirano
7,682,262 B2 3/2010 Soracco et al.
7,749,097 B2 7/2010 Foster et al.
7,931,545 B2 4/2011 Soracco et al.
7,935,003 B2 5/2011 Matsunaga
8,012,041 B2 9/2011 Gibbs et al.
8,070,623 B2 * 12/2011 Stites ..... A63B 53/0466 473/329
8,226,498 B2 7/2012 Stites
8,235,841 B2 8/2012 Stites
8,235,844 B2 8/2012 Albertsen
8,272,975 B2 9/2012 Morin
8,328,659 B2 12/2012 Shear
8,337,319 B2 12/2012 Sargent et al.
8,632,419 B2 1/2014 Tang et al.
8,657,701 B2 2/2014 Boyd
8,845,454 B2 * 9/2014 Boyd ..... A63B 53/0466 473/328
9,999,811 B2 * 6/2018 Boyd ..... A63B 53/0466
2007/0015601 A1 1/2007 Tsunoda

* cited by examiner

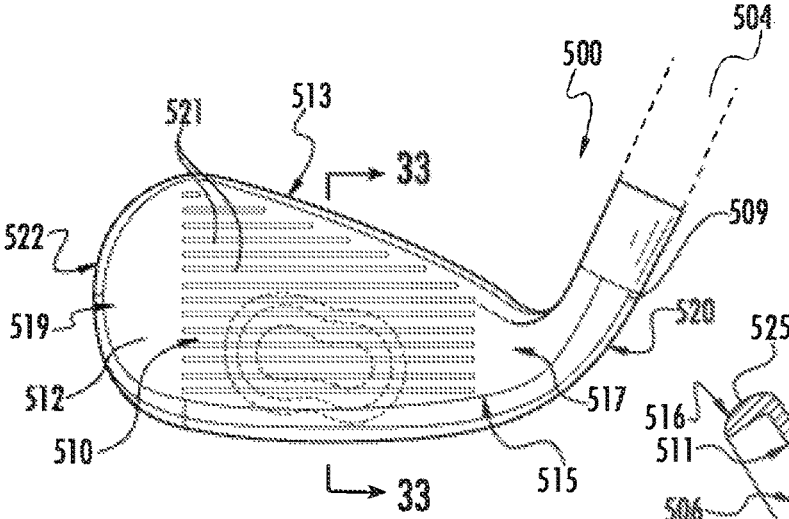
FIG. 32
FIG. 33
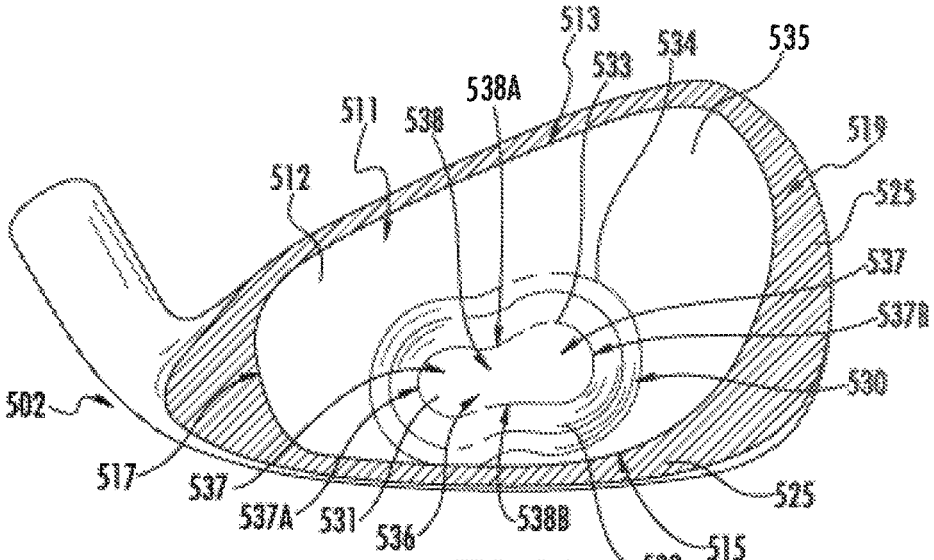
FIG. 34

GOLF CLUB HEAD OR OTHER BALL STRIKING DEVICE HAVING STIFFENED FACE PORTION

This application is a continuation of U.S. patent application Ser. No. 14/497,826 filed Sep. 26, 2014, which is a continuation of U.S. patent application Ser. No. 13/211,961, filed Aug. 17, 2011, now U.S. Pat. No. 8,845,454 issued Sep. 30, 2014, which is a continuation-in-part of co-pending U.S. patent application Ser. No. 12/276,080, filed Nov. 21, 2008, now U.S. Pat. No. 8,070,623, issued on Dec. 6, 2011, all of which are incorporated herein by reference in their entireties and made parts hereof.

TECHNICAL FIELD

The invention relates generally to ball striking devices, such as golf clubs and golf club heads, having a stiffened or thickened portion on the ball striking face thereof. Certain aspects of this invention relate to golf club heads having one or more stiffening members extending rearward from an inner surface of the face.

BACKGROUND OF THE INVENTION

The energy or velocity transferred to the ball by a golf club or other ball striking device may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at or near the center of the face. In one example, the area of highest response may have a COR that is equal to the prevailing USGA limit (e.g. currently 0.83). However, because golf clubs are typically designed to contact the ball at or around the center of the face, off-center hits with many existing golf clubs may result in less energy being transferred to the ball, decreasing the distance of the shot.

The flexing behavior of the ball striking face and/or other portions of the head during impact can also influence the energy and velocity transferred to the ball, the direction of ball flight after impact, and the spin imparted to the ball, among other factors. Accordingly, a need exists to alter and/or improve the deformation and response of the ball striking face and/or other portions of the head during impact. The flexing behavior of the ball itself during impact can also influence some or all of these factors. Excess deformation of the ball during impact can result in energy loss, such as in the form of heat. Certain characteristics of the face and/or other portions of the head during impact can have an effect on the deformation of the ball. Accordingly, a need also exists to provide a ball striking head with features that cause altered and/or improved deformation behavior of the ball during impacts with the ball striking face of the head.

The present devices and methods are provided to address at least some of the problems discussed above and other problems, and to provide advantages and aspects not provided by prior ball striking devices of this type. A full discussion of the features and advantages of the present invention is deferred to the following detailed description, which proceeds with reference to the accompanying drawings.

SUMMARY OF THE INVENTION

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face and extending rearwardly from the face. Various example structures of faces described herein include a thickened portion that forms a protrusion extending inwardly from the inner surface of the face, the thickened portion including an annular tapered area that tapers in thickness between an upper boundary and a lower boundary and encloses an elevated area bounded by the upper boundary. At least one of the upper and lower boundaries defines a shape including a first lobe having a first outer edge with a convex outer profile, a second lobe having a second outer edge with a convex outer profile, and a connecting portion extending between the first lobe and the second lobe, such that the connecting portion is defined by third and fourth outer edges extending between the first and second outer edges. At least one of the third and fourth outer edges has a concave outer profile. In one embodiment, both of the third and fourth outer edges have concave outer profiles. In another embodiment, only one of the third and fourth outer edges has a concave outer profile, and the edge with the concave profile may be the top edge or the bottom edge of the connecting portion.

According to one aspect, at least a portion of the elevated area has a generally constant thickness. For example, the elevated area may be or include a plateau area having a generally constant thickness over the entire area within the upper boundary of the annular tapered area. As another example, the elevated area may be multi-tiered, including a first plateau area having a first generally constant face thickness, a second plateau area having a second generally constant face thickness, and a tapered area extending between the first and second plateau areas.

According to another aspect, the body may further include an inwardly recessed channel extending across at least a portion of a sole of the body and being spaced rearwardly from a bottom edge of the face. The channel may include two boundary edges extending generally parallel to the bottom edge of the face and two walls extending inwardly from the boundary edges to form a recessed trough with a curvilinear profile.

According to a further aspect, the thickened portion further includes a second annular tapered area that tapers in thickness between a second upper boundary and a second lower boundary and encloses the annular tapered area and the elevated area completely. The thickened portion may also include an annular plateau area having a generally constant thickness, with the annular plateau area extending between the annular tapered area and the second annular tapered area. In one embodiment, at least one of the second upper and lower boundaries defines a shape including a third lobe having a fifth outer edge with a convex outer profile, a fourth lobe having a sixth outer edge with a convex outer profile, and a second connecting portion extending between the third lobe and the fourth lobe, such that the second connecting portion is defined by seventh and eighth outer edges extending between the fifth and sixth outer edges. At least one of the seventh and eighth outer edges has a concave outer profile.

According to yet another aspect, the shape defined by the upper or lower boundary is elongated to have a maximum dimension along a first axis, and the first and second lobes are larger or wider than the connecting portion in a direction transverse or perpendicular to the first axis. Put another way, the first lobe has a first dimension along a second axis perpendicular to the first axis, the second lobe has a second dimension along the second axis, and the connecting portion has a third dimension along the second axis that is smaller than the first and second dimensions. In some embodiments, the first dimension can be larger than the second dimension. In other embodiments, the second dimension can be larger than the first dimension.

According to an additional aspect, the face may be formed as part of a face member that may have a cup-face configuration or an L-shaped configuration. In the cup face configuration, the face member includes the face and a plurality of walls extending rearward from peripheral edges of the face, and the body is at least partially formed by one or more body members connected to the walls and extending rearwardly from the face member. In the L-shaped configuration, the face member includes the face and a wall extending rearward from a bottom edge of the face, and the body is at least partially formed by one or more body members connected to the wall and connected to peripheral edges of the face and extending rearwardly from the face member.

Additional aspects of the invention relate to ball striking devices, such as golf clubs, with a head that includes a face configured for striking a ball and a body connected to the face and extending rearwardly from the face. The face has an elevated area protruding from the inner surface and having increased thickness relative to surrounding portions of the face. The elevated area is completely or at least partially enclosed by an annular tapered area that decreases in thickness from the elevated area outward, such that the elevated area has a peripheral edge defined by an inner edge of the tapered area. The peripheral edge of the elevated area defines a shape including a first lobe having a first outer edge with a convex outer profile, a second lobe having a second outer edge with a convex outer profile, and a connecting portion extending between the first lobe and the second lobe. The connecting portion is defined by third and fourth outer edges extending between the first and second outer edges, and at least one of the third and fourth outer edges has a concave outer profile. In one embodiment, both of the third and fourth outer edges have concave outer profiles. In another embodiment, only one of the third and fourth outer edges has a concave outer profile, and the edge with the concave profile may be the top edge or the bottom edge of the connecting portion. These aspects and embodiments may include any additional aspects and embodiments described above.

Further aspects of the invention relate to ball striking devices, such as golf clubs, with a head that includes a face configured for striking a ball and a body connected to the face and extending rearwardly from the face. The face has an elevated area protruding from the inner surface and having increased thickness relative to surrounding portions of the face. The elevated area is completely or at least partially enclosed by an annular tapered area that decreases in thickness from the elevated area outward, such that the elevated area has a peripheral edge defined by an inner edge of the tapered area. The peripheral edge of the elevated area defines a shape that is elongated to have a maximum dimension along a first axis, and the shape includes a first enlarged area having a first dimension along a second axis perpendicular to the first axis, a second enlarged area having a second dimension along the second axis, and a narrowed connecting portion connecting the first area and the second area. The connecting portion has a third dimension along the second axis that is smaller than the first and second dimensions. In one embodiment, the first axis may be angled with respect to a horizontal direction, which may be defined by a sole of the body and/or a lie angle of the head. The angle may be up to approximately 18°, or up to approximately 15°. In another embodiment, the connecting portion may have a top edge and a bottom edge extending between the first and second enlarged areas, and at least one of the top and bottom edges may have a concave profile. These aspects and embodiments may include any additional aspects and embodiments described above.

Still further aspects of the invention relate to ball striking devices, such as golf clubs, with a head that includes a face member comprising a face configured for striking a ball with an outer surface thereof and a wall extending rearwardly from a bottom edge of the face, and a body formed of at least one body member connected to the face and extending rearwardly from the face. The face has an inner surface opposite the outer surface and an elevated area protruding from the inner surface and having increased thickness relative to surrounding portions of the face. The at least one body member is connected to the wall and around peripheral edges of the face, such that the wall forms a portion of a sole of the body, and the face member and the at least one body member combine to define an internal cavity.

According to one aspect, the elevated area is completely enclosed by an annular tapered area that decreases in thickness from the elevated area outward. In one embodiment, the elevated area has a peripheral edge defined by an inner edge of the annular tapered area, and the peripheral edge defines a shape including a first lobe having a first outer edge with a convex outer profile, a second lobe having a second outer edge with a convex outer profile, and a connecting portion extending between the first lobe and the second lobe. In this configuration, the connecting portion is defined by third and fourth outer edges extending between the first and second outer edges, and at least one of the third and fourth outer edges has a concave outer profile. In another embodiment, the elevated area has a peripheral edge defined by an inner edge of the annular tapered area, and the peripheral edge defines a shape that is elongated to have a maximum dimension along a first axis. In this configuration, the shape of the elevated area includes a first enlarged area having a first dimension along a second axis perpendicular to the first axis, a second enlarged area having a second dimension along the second axis, and a narrowed connecting portion connecting the first area and the second area, with the connecting portion having a third dimension along the second axis that is smaller than the first and second dimensions.

According to another aspect, in which the golf club head is a wood-type golf club head (including drivers or fairway woods) or a hybrid-type golf club head, the internal cavity may be completely enclosed by the face member and the at least one body member. If the golf club head is an iron-type head, the internal cavity may be at least partially open.

Other aspects of the invention relate to a golf club that includes a golf club head as described above and a shaft engaged with the head. Further aspects relate to a set of golf clubs that includes a plurality of clubs according to aspects described above, and may include at least one wood-type club and/or at least one iron-type club.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 32 is a front view of another embodiment of a head of a ball striking device according to aspects of the invention, in the form of an iron-type golf club head;

FIG. 33 is a cross-section view taken along lines 33-33 of FIG. 32;

FIG. 34 is a cross-section view taken along lines 34-34 of FIG. 32;

DETAILED DESCRIPTION

Figure 1:
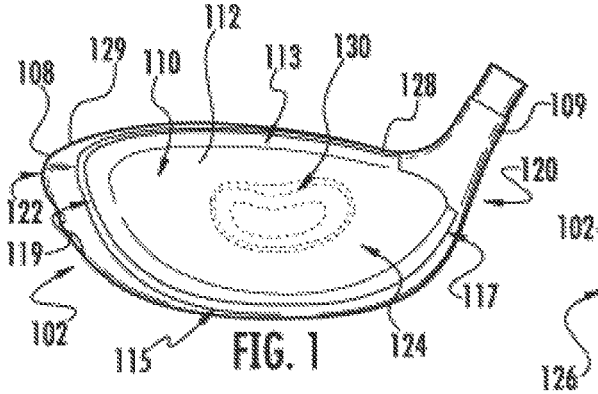
FIG. 1 is a front view of one embodiment of a head of a ball striking device according to aspects of the invention, in the form of a wood-type golf club head.
Figure 2:
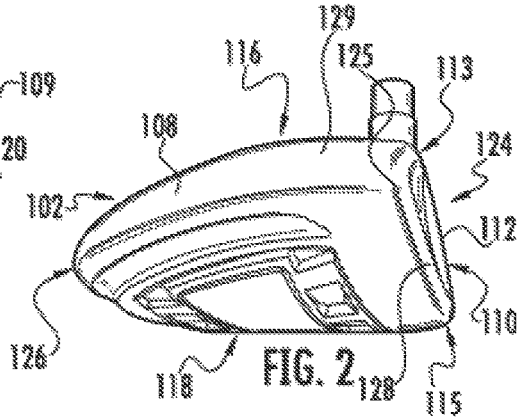
FIG. 2 is a side view of the head of FIG. 1.
Figure 3:
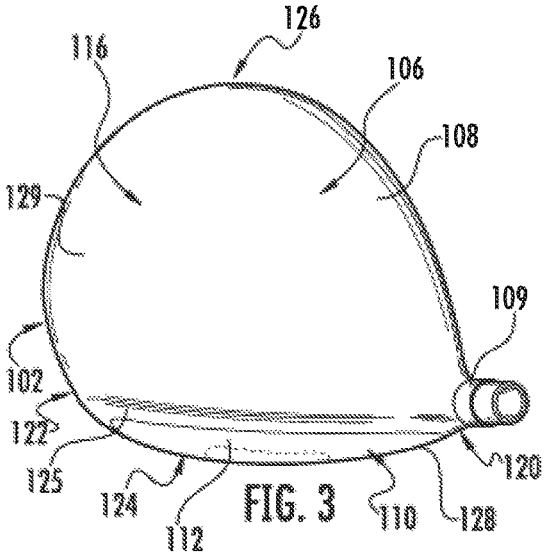
FIG. 3 is a top view of the head of FIG. 1.
Figure 4:
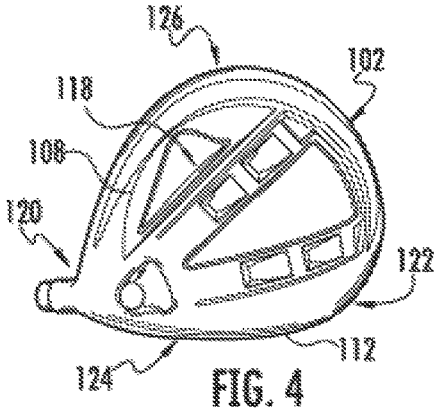
FIG. 4 is a bottom view of the head of FIG. 1.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," "primary," "secondary," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The term "shaft" includes the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like. In many bonds made by "integral joining techniques," separation of the joined pieces cannot be accomplished without structural damage thereto.

"Transverse" is not limited to perpendicular or generally perpendicular intersections, and refers broadly to a variety of angled intersections.

"Approximately" incorporates a variation or error of +/−10% of the nominal value stated.

"Generally constant thickness" incorporates a variation or error of +/−5% of the average thickness over the entirety of the area in question.

"Annular" refers to a ring-like shape, but does not imply any particular shape or contour, such as circular, elliptical, etc.

The term "thickness" or "face thickness," when used in reference to a ball striking face as described herein refers to the distance between the ball striking surface and the inner surface of the face. The thickness is generally the distance between a point on the inner or outer surface of the face and the nearest point on the outer or inner surface of the face, respectively, and may be measured perpendicularly to the inner or outer surface at the point in question.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface may constitute a substantially flat surface on one face of the ball striking head, although some curvature may be provided (e.g., "bulge" or "roll" characteristics). Some more specific aspects of this invention relate to wood-type golf clubs and golf club heads, including drivers, fairway woods, hybrid-type clubs, iron-type golf clubs, and the like, although aspects of this invention also may be practiced on other types of golf clubs or other ball striking devices, if desired.

According to various aspects of this invention, the ball striking device may be formed of one or more of a variety of materials, such as metals (including metal alloys), ceramics, polymers, composites, fiber-reinforced composites, and wood, and the devices may be formed in one of a variety of configurations, without departing from the scope of the invention. In one embodiment, some or all components of the head, including the face and at least a portion of the body of the head, are made of metal materials. It is understood that the head also may contain components made of several different materials. Additionally, the components may be formed by various forming methods. For example, metal components (such as titanium, aluminum, titanium alloys, aluminum alloys, steels (such as stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices and portions thereof according to this invention. When the same reference number appears in more than one drawing, that reference number is used consistently in this specification and the drawings to refer to the same or similar parts throughout.

At least some examples of ball striking devices according to this invention relate to golf club head structures, including heads for wood-type golf clubs, including drivers. Such devices may include a one-piece construction or a multiple-piece construction. An example structure of ball striking devices according to this invention will be described in detail below in conjunction with FIGS. 1-8, and will be referred to generally using reference numeral "100."

FIGS. 1-5 illustrate an example of a ball striking device 100 in the form of a golf driver, in accordance with at least some examples of this invention. The ball striking device 100 includes a ball striking head 102 and a shaft 104 connected to the ball striking head 102 and extending therefrom. The ball striking head 102 of the ball striking device 100 of FIGS. 1-5 has a face 112 connected to a body 108, with a hosel 109 extending therefrom. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May. 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties.

For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIGS. 1-5, the head 102 has a relatively large volume, as the club 100 is designed for use as a driver or wood-type club, intended to hit the ball accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. Other appropriate sizes for other club heads may be readily determined by those skilled in the art.

In the embodiment illustrated in FIGS. 1-5, the head 102 has a hollow structure defining an inner cavity 106 (e.g., defined by the face 112 and the body 108). Thus, the head 102 has a plurality of inner surfaces defined therein. In one embodiment, the hollow center cavity 106 may be filled with air. However, in other embodiments, the head 102 could be filled with another material, such as a foam. In still further embodiments, the solid materials of the head may occupy a greater proportion of the volume, and the head may have a smaller cavity or no inner cavity at all. It is understood that the inner cavity 106 may not be completely enclosed in some embodiments.

The face 112 is located at the front 124 of the head 102, and has a ball striking surface 110 located thereon. The ball striking surface 110 is configured to face a ball in use, and is adapted to strike the ball when the device 100 is set in motion, such as by swinging. As shown, the ball striking surface 110 occupies most of the face 112. For reference purposes, the portion of the face 112 near the top face edge 113 and the heel face edge 117 is referred to as the "high-heel area"; the portion of the face 112 near the top face edge 113 and the toe face edge 119 is referred to as the "high-toe area"; the portion of the face 112 near the bottom face edge 115 and the heel face edge 117 is referred to as the "low-heel area"; and the portion of the face 112 near the bottom face edge 115 and the toe face edge 119 is referred to as the "low-toe area". Conceptually, these areas may be recognized as quadrants of substantially equal size (and/or quadrants extending from a geometrical center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the embodiment shown in FIGS. 1-8, the ball striking surface 110 is inclined slightly (i.e., at a loft angle), to give the ball 106 slight lift and/or spin when struck. In other embodiments, the ball striking surface 110 may have a different incline or loft angle, to affect the trajectory of the ball 106. Additionally, the face 112 may have one or more internal or external inserts in some embodiments.

Figure 6:
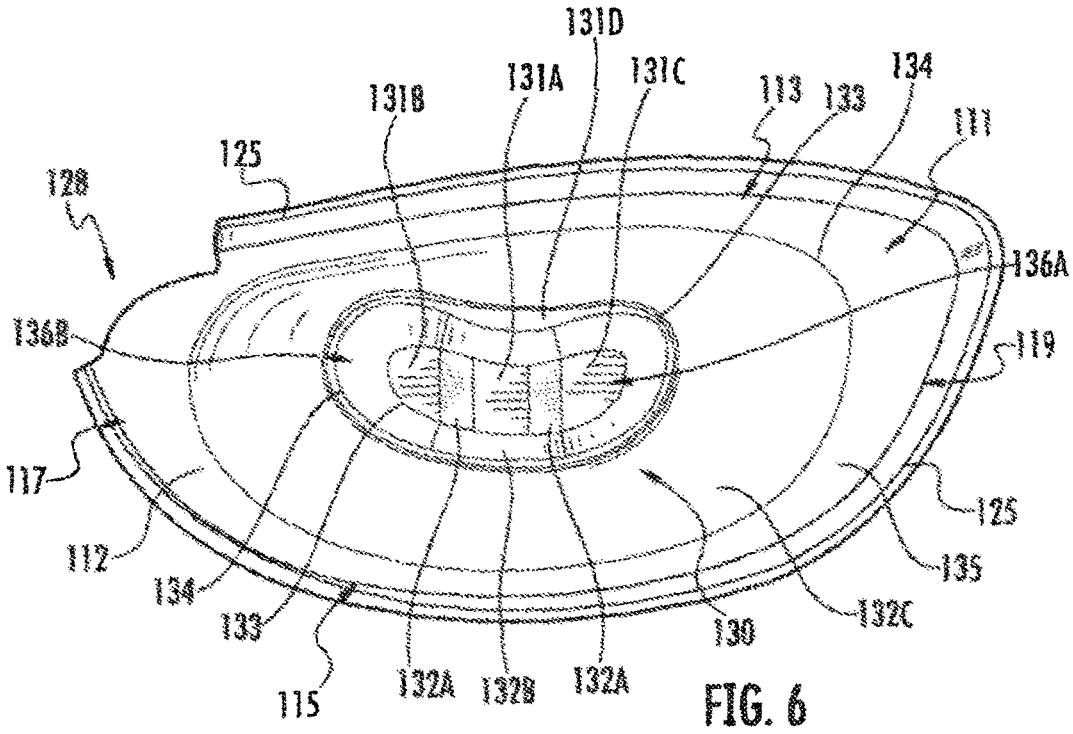
FIG. 6 is a rear view of a face of the head of FIG. 1.
Figure 7:
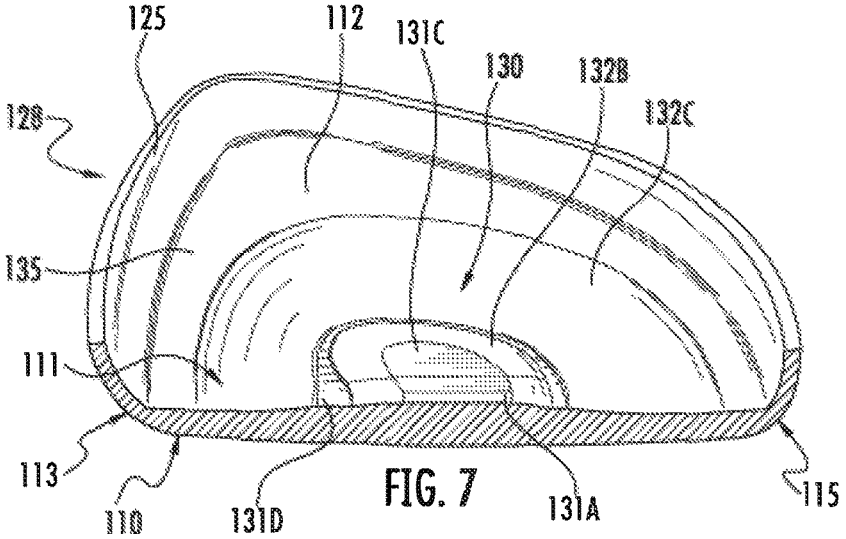
FIG. 7 is a cross-section view taken along lines 7-7 of FIG. 6.
Figure 8:
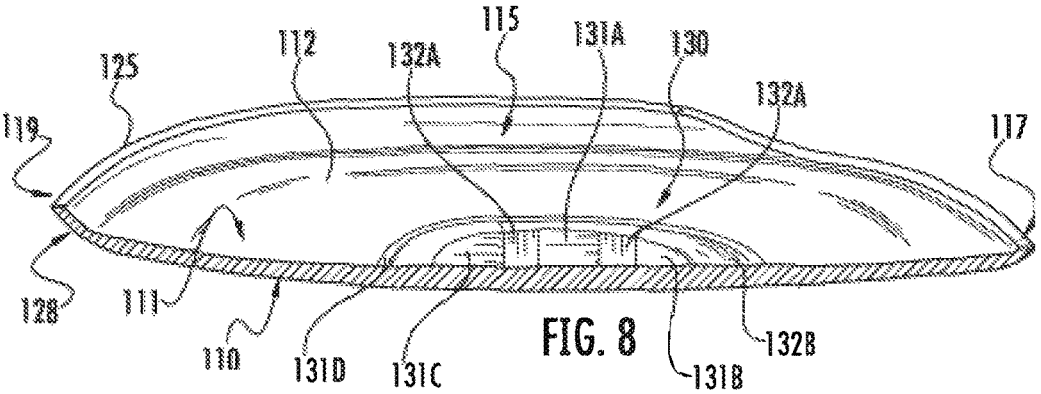
FIG. 8 is a cross-section view taken along lines 8-8 of FIG. 6.

It is understood that the face 112, the body 108, and/or the hosel 109 can be formed as a single piece or as separate pieces that are joined together. In one embodiment, the face 112 is formed from a face member 128 having a cup-face structure, such as shown in FIGS. 6-8, with a wall or walls 125 extending transverse and rearward from the edges 127 of the inner face surface 111. The body 108 can be formed as a separate piece or pieces joined to the walls 125 of the cup-face by an integral joining technique, such as welding, cementing, or adhesively joining. In the embodiment illustrated in FIGS. 1-8, the body 108 is at least partially formed by a body member 129 that is connected to the walls 125 of the face member 128 and extends rearwardly from the face member 128. Other known techniques for joining these parts can be used as well, including many mechanical joining techniques, such as releasable mechanical engagement techniques. If desired, the hosel 109 may be integrally formed as part of the cup-face member 128.

Figure 5:
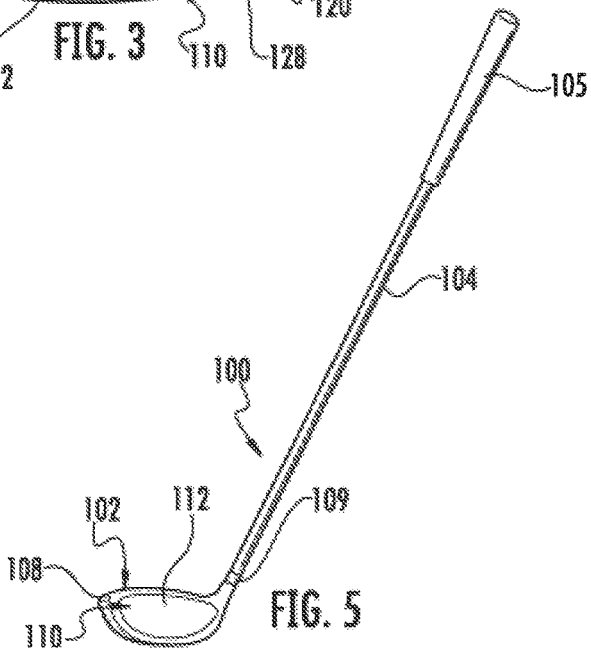
FIG. 5 is a front view of one embodiment of a ball-striking device according to aspects of the invention, including the head of FIG. 1, in the form of a wood-type golf club.

The ball striking device 100 may include a shaft 104 connected to or otherwise engaged with the ball striking head 102, as shown in FIG. 5. The shaft 104 is adapted to be gripped by a user to swing the ball striking device 100 to strike the ball 106. The shaft 104 can be formed as a separate piece connected to the head 102, such as by connecting to the hosel 109, as shown in FIG. 5 and described above. In other embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some exemplary embodiments, the shaft 104, or at least portions thereof, may be constructed of a metal, such as stainless steel, or a composite, such as a carbon/graphite fiber-polymer composite. However, it is contemplated that the shaft 104 may be constructed of different materials without departing from the scope of the invention, including conventional materials that are known and used in the art.

In general, the head 102 of the ball striking device 100 has one or more thickened face portions extending rearward from the inner surface 111 of the face 112 and creating one or more protrusions on the inner surface 111 of the face. The thickened face portions provide increased stiffness to surrounding areas or portions of the face 112, and can therefore be considered to constitute stiffening members. FIGS. 1-36 illustrate various embodiments of ball striking devices 200, 300, 400, 500 and ball striking faces 212, 212', 312, 412, 512, having different face configurations with differently-configured thickened portions. Each of these configurations can be used as the face 112 of a ball striking device, such as the ball striking device 100 as shown in FIGS. 1-5, or various other configurations for ball striking devices within the scope of the present invention, additional examples of which are shown herein. Thus, common features of the face 112 and the faces 212, et seq., described below are referred to with similar reference numbers used to describe the face 112 of FIGS. 1-8, using different series (e.g. 1xx, 2xx, 3xx, etc.) of reference numbers.

The thickened portions of the various embodiments described herein, or definable portions of such thickened portion(s), may have shapes that are elongated and may be elliptical or semi-elliptical, multi-lobed, or generally peanut- or kidney-shaped. In one embodiment, the thickened portion or a definable portion thereof has outer edges defining a shape that includes two lobes, where the outer edge has a convex outer profile, and a connecting portion extending between the lobes, such that the connecting portion is defined by outer edges extending between the outer edges of the lobes, with at least one of the outer edges of the connecting portion having a concave profile. If only one of the outer edges of the connecting portion is concave, the resultant shape may be what is referred to as a kidney-shaped thickened portion. For example, the thickened portion 130 shown in FIGS. 1-8 has several portions that define or are defined by kidney shapes, including at least two definable elevated areas 136A-B and at least two definable tapered portions 132B-C. If both of the outer edges of the connecting portion are concave, the resultant shape may be what is referred to as a peanut-shaped thickened portion. For example, the thickened portions 230, 330, 430, 530 shown in FIGS. 9-36 each have several portions that define or are defined by peanut shapes, including at least one definable elevated area 236, 336, 436, 536 and at least one definable tapered portion 232, 332, 432, 532. Additionally, in one embodiment, the shape of the thickened portion (or definable portion thereof) may be elongated along an axis and may have two enlarged areas or lobes connected by a connecting area. The enlarged lobes each have dimensions measured along a second axis perpendicular to the first axis, and the lobes are wider (i.e. have greater dimensions perpendicular to the axis of elongation) than the connecting area, which is narrowed with respect to the lobes. Various embodiments that exhibit one or more of these properties are described below with respect to FIGS. 1-36.

Figure 6A:
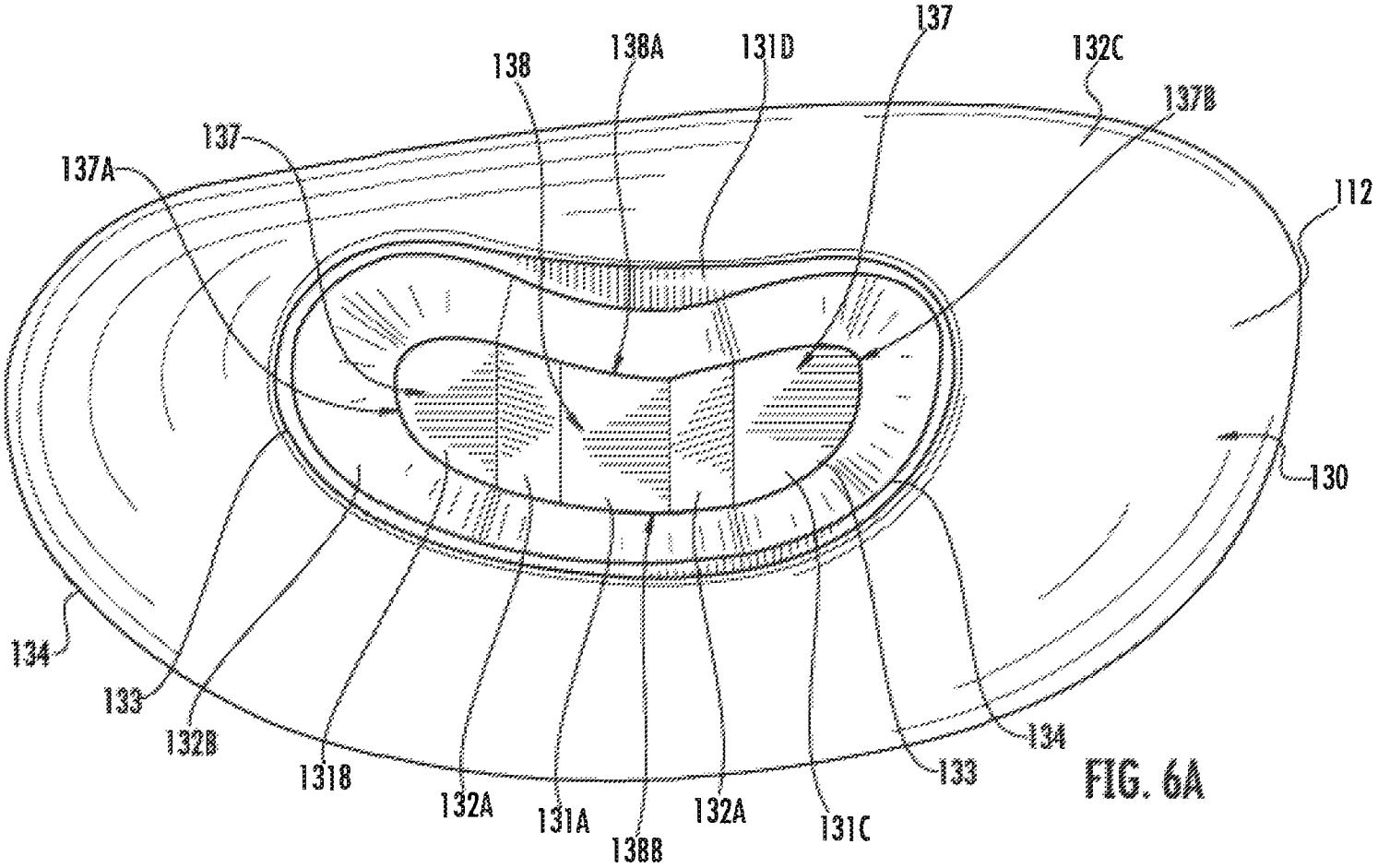
FIG. 6A is a magnified rear view of a thickened portion of the face of FIG. 6.

FIGS. 1-8 illustrate an embodiment of a ball striking head 102 with a face 112 that includes a thickened portion 130 on the inner surface 111 of the face 112, with the thickened portion 130 having a greater thickness than surrounding areas of the face 112 and a greater thickness than any other portion of the face 112. In this embodiment, the thickened portion 130 has several different contours and levels, including a plurality of plateau areas 131A-D having generally constant thicknesses and a plurality of tapered areas 132A-C having tapering thicknesses that increase or decrease between boundary edges 133, 134. These various surface and thickness features are described in greater detail below and are shown in greater detail in FIG. 6A. Additionally, in the embodiment of FIGS. 1-8, the face 112 is formed from a face member 128 having a cup-face structure, with a wall or walls 125 extending rearward from the edges 127 of the inner face surface 111, as described above. In this embodiment, the body 108 is formed by connecting one or more body members 129 to the wall(s) 125 of the face member 128. In other embodiments, the face 112 may be formed by a face plate, similar to the embodiment of FIGS. 9-14, or an L-shaped or inverted L-shaped face member, similar to the embodiments of FIGS. 15-31.

The thickened portion 130 of the face 112 of FIGS. 1-8 includes a first elevated area 136A that may be considered to be bounded and defined completely by an annular tapered area 132B that has an upper or inner edge or boundary 133 defining the first elevated area 136A and a lower or outer edge or boundary 134. It is understood that for this tapered area 132B and all tapered areas described herein as being annular, the boundaries or edges 133, 134 of such areas are also annular. The thickness of the tapered area 132B decreases from the inner edge 133 to the outer edge 134. The degree of tapering of this tapered area 132B and other tapered areas described herein may be constant (i.e. linear), may be curvilinear and/or may follow a regular mathematical relationship (i.e. parabolic, hyperbolic, semi-circular, semi-elliptical), may be instantaneous (e.g. a 90° drop), or may be irregular or may follow a different pattern. Additionally, the degree of tapering of this tapered area 132B or any other tapered area described herein may be the same over the entirety of the tapered area 132B, or may be different in different locations. Further, the tapering of this tapered area 132B and other tapered areas described herein is continuous between the defined edges or boundaries 133, 134. In the embodiment shown in FIGS. 6-8, the tapered area 132B has a generally curvilinear taper, and the degree of tapering varies at different locations of the tapered area 132B. The face 112 has a generally constant thickness at the outer edge 134 of the tapered area 132B, and the thickness of the face 112 around the inner edge 133 varies.

In one embodiment, at least one of the inner and outer edges 133, 134 of the annular tapered area 132B defines outer edges of a shape that includes a first lobe 137, where the outer edge 137A has a convex outer profile, a second lobe 137, where the outer edge 137B has a convex outer profile, and a connecting portion 138 extending between the lobes 137, such that the connecting portion 138 is defined by outer edges 138A-B extending between the outer edges 137A-B of the first and second lobes 137, with at least one of the outer edges 138A-B of the connecting portion 138 having a concave profile. In the embodiment shown in FIGS. 6-8, both the inner and outer edges 133, 134 of the tapered area 132B define a kidney shape, with the upper edge 138A of the connecting portion 138 having a concave profile and the lower edge 138B of the connecting portion 138 having a convex profile. In another embodiment, the upper and/or lower edge 138A-B may have at least a portion that has a concave profile, and may include one or more convex portions as well.

The first elevated area 136A is multi-tiered, and includes a generally rectangular or quadrilateral-shaped plateau area 131A having a maximum face thickness and second and third semi-elliptically shaped plateau areas 131B,C on the sides of the first plateau area 131A. The second and third plateau areas 131B,C have face thicknesses that are smaller than the first plateau area 131A, and two substantially rectangular or quadrilateral-shaped tapered areas 132A extend from the first plateau area 131A to the second and third plateau areas 131B,C. In this embodiment, the face thickness at all points in the first elevated area 136A is greater than the face thickness at any other location on the face 112. The first elevated area 136A is defined by the inner edge 133 of the annular tapered area 132B, such that the inner edge 133 of the annular tapered area 132B forms a peripheral edge of the first elevated area 136A. As a result, the shape defined by the outer edge of the first elevated area 136A is the same as the shape defined by the inner edge 133 of the annular tapered area 132B as described above. It is understood that any of the potential variations described above with respect to the shape defined by the annular tapered area 132B may be incorporated into the shape of the first elevated area 136A, in other embodiments. It is further understood that the first elevated area 136A and the annular tapered area 132B may be considered together to form an elevated area having a greater face thickness than surrounding areas of the face 112, and having an outer edge defining a kidney shape as described above.

The thickened portion 130 of the face 112 in FIGS. 1-8 also includes a fourth plateau area 131D that is annular and extends around the outer edge 134 of the annular tapered area 132B. The fourth plateau area 131D has a face thickness that is smaller than the thickness of the first, second, or third plateau areas 131A-C. The fourth plateau area 131D is surrounded and defined by a second annular tapered area 132C which has an inner edge 133 that forms and defines the outer edge of the fourth plateau area 131D and an outer edge 134, such that the second annular tapered area 132C tapers to decrease in thickness from the inner edge 133 to the outer edge 134. The second annular tapered area 132C is surrounded at the outer edge 134 by a peripheral area 135 that extends to the edges 113, 115, 117, 119 of the face 112. The peripheral area 135 may have a generally constant thickness or a variable thickness, and at least a portion of the peripheral area 135 has the minimum or smallest face thickness of the entire face 112.

In one embodiment, at least one of the inner and outer edges 133, 134 of the second annular tapered area 132C defines outer edges of a shape that includes a first lobe 137, where the outer edge 137A has a convex outer profile, a second lobe 137, where the outer edge 137B has a convex outer profile, and a connecting portion 138 extending between the lobes 137, such that the connecting portion 138 is defined by outer edges 138A-B extending between the outer edges 137A-B of the first and second lobes 137, with at least one of the outer edges 138A-B of the connecting portion 138 having a concave profile. In the embodiment shown in FIGS. 6-8, the inner edge 133 of the second annular tapered area 132C defines a kidney shape, with the upper edge 138A of the connecting portion 138 having a concave profile and the lower edge 138B of the connecting portion 138 having a convex profile. As described above, the fourth plateau area 131D has its inner edge formed by the outer edge 134 of the annular tapered area 132B and its outer edge formed by the inner edge 133 of the second annular tapered area 132C. As a result, the inner and outer peripheral edges of the fourth plateau area 131D form kidney shapes as described above. Further, the inner edge 133 of the second annular tapered area 132C can be considered to define a second elevated area 136B that includes the fourth plateau area 131D, the annular tapered area 132B, and the entirety of the first elevated area 136A. Every point within the second elevated area 136B has a greater face thickness than any surrounding point of the face 112. Because the inner edge 133 of the second annular tapered area 132C forms the outer edge of the second elevated area 136B, the second elevated area 136B can also be considered to have a kidney shape, as described above.

Additionally, in the embodiment illustrated in FIGS. 1-8, the shape(s) defined by the edges 133, 134 of the annular tapered areas 132B-C, including the shapes of the elevated areas 136A-B, are elongated along an axis of elongation (e.g., generally horizontal in FIG. 6). In one embodiment, the lobes 137 each have dimensions measured along a second axis perpendicular to the axis of elongation (e.g., generally vertical in FIG. 6), and the lobes 137 may have greater dimensions perpendicular to the axis of elongation than the connecting area 138, which may be narrowed with respect to the lobes 137.

In one embodiment of the face 112 illustrated in FIGS. 1-8, the first raised area 136A has a total area of approximately 249 $mm^2$, with the first plateau area 131A having an area of approximately 62 $mm^2$, the second plateau area 131B having an area of approximately 48 $mm^2$, the third plateau area 131C having an area of approximately 64 $mm^2$, and the rectangular tapered areas 132A each having an area of approximately 36-37 $mm^2$. In this embodiment, the second raised area 136B has a total area of approximately 768 $mm^2$, with the fourth plateau area 131D having an additional area of approximately 124 $mm^2$ and the annular tapered area 132B having an additional area of approximately 395 $mm^2$. Further, in this embodiment, the second annular tapered area 132C has an area of approximately 2172 $mm^2$ and the peripheral area 135 has an area of approximately 1373 $mm^2$, such that the totality of the inner surface 111 of the face 112 has an approximate area of 4313 $mm^2$. Additionally, in one embodiment of the face 112 illustrated in FIGS. 1-8, the first plateau area 131A has a generally constant thickness of approximately 3.63 mm, the second plateau area 131B has a generally constant thickness of approximately 3.53 mm, the third plateau area 131C has a generally constant thickness of approximately 3.38 mm, the fourth plateau area 131D has a generally constant thickness of approximately 3.30 mm, and the peripheral area has a generally constant thickness of approximately 2.08 mm. In an alternate embodiment, where the plateau areas 131A-D and/or the peripheral area 135 do not have generally constant thicknesses, the maximum thickness of the first plateau area 131A is approximately 3.63 mm, and the minimum thickness of the peripheral area 135 is approximately 2.08 mm. It is understood that in one embodiment, the thicknesses of these various portions of the face 112 may be increased or decreased, while maintaining the same or approximately the same relative differences in thickness, either as a proportion or an absolute difference.

It is understood that any of the plateau areas 131A-D, the tapered areas 132A-C, the elevated areas 136A-B, and/or the peripheral area 135 may have different shapes, orientations, and/or thickness profiles in other embodiments. For example, in other embodiments, the features may have a kidney shape that may be differently oriented, such as being rotated 180° from its present orientation so that the lower edge 138B of the connecting portion 138 is concave and the upper edge 138A is convex, or the annular tapered portions 132B-C may define a different shape, such as a peanut shape as described below with respect to other embodiments, a circular shape, an elliptical or obround shape, etc.

FIGS. 9-14 illustrate another embodiment of a ball striking head 202 in the form of a golf driver with a face 212 that includes a thickened portion 230 on the inner surface 211 of the face 212, extending inwardly to create a protrusion on the inner surface 211 of the face 212. The thickened portion 230 has a greater thickness than surrounding areas of the face 212 and a greater thickness than any other portion of the face 212. The embodiments of the ball striking device 200 and the face 212 illustrated in FIGS. 9-14 contain features similar to those of the embodiments described above with respect to FIGS. 1-8, and similar components in the embodiment of FIGS. 9-14 are similarly referred to using the "2xx" series of reference numbers. It is understood that discussion of some features of the embodiment of FIGS. 9-14 that have already been described above may be reduced or eliminated in the interests of brevity.

In one embodiment, the thickened portion 230 has at least one plateau area 231 having a generally constant thickness, and at least one tapered area 232 having a tapering thickness that increases or decreases between boundary edges 233, 234. In the embodiment illustrated in FIGS. 9-14, the thickened portion 230 includes a single plateau area 231 that is bounded and defined completely by an annular tapered area 232 that has an upper or inner edge or boundary 233 defining the outer edge of the plateau area 231 and a lower or outer edge or boundary 234. The plateau area 231 has a generally constant thickness that is the maximum face thickness of the entire face 212. The thickness of the tapered area 232 decreases from the inner edge 233 to the outer edge 234. In the embodiment shown in FIGS. 9-14, the tapered area 232 has a generally curvilinear taper. The face 212 has a generally constant thickness at the outer edge 234 of the tapered area 232, and the peripheral area 235 surrounding the tapered area 232 has a generally constant thickness.

In one embodiment, at least one of the inner and outer edges 233, 234 of the annular tapered area 232 defines outer edges of a shape that includes a first lobe 237, where the outer edge 237A has a convex outer profile, a second lobe 237, where the outer edge 237B has a convex outer profile, and a connecting portion 238 extending between the lobes 237, such that the connecting portion 238 is defined by outer edges 238A-B extending between the outer edges 237A-B of the first and second lobes 237, with at least one of the outer edges 238A-B of the connecting portion 238 having a concave profile. In the embodiment shown in FIGS. 9-14, both the inner and outer edges 233, 234 of the tapered area 232 define a peanut shape, with the upper and lower edges 238A-B of the connecting portion 238 having concave profiles. Because the inner edge 233 of the tapered area 232 forms the outer edge of the plateau area 231, the outer edge of the plateau area 231 also defines a peanut shape as described above. Further, either or both of the inner and outer edges 233, 234 of the tapered area 232 may be considered to define an elevated area 236 that has a greater face thickness than the surrounding areas of the face and has an outer edge defining a peanut shape as described above.

Figure 9:
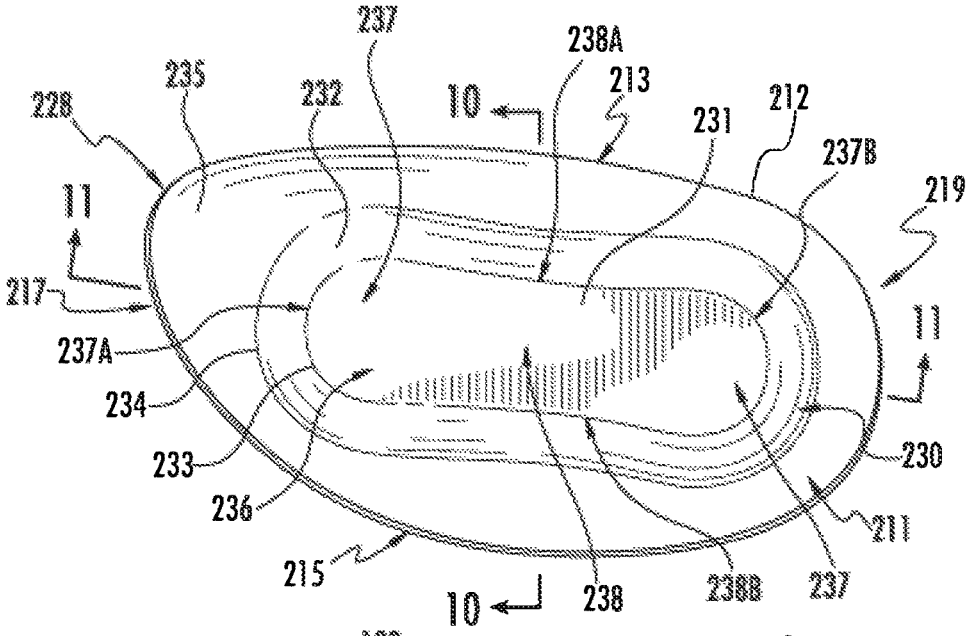
FIG. 9 is a rear view of another embodiment of a face for a head of a ball striking device according to aspects of the invention.
Figure 10:
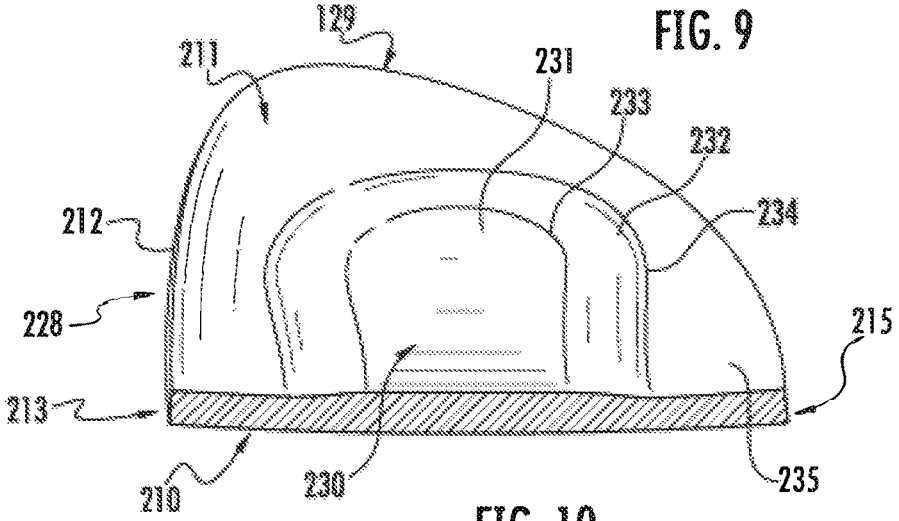
FIG. 10 is a cross-section view taken along lines 10-10 of FIG. 9.
Figure 11:
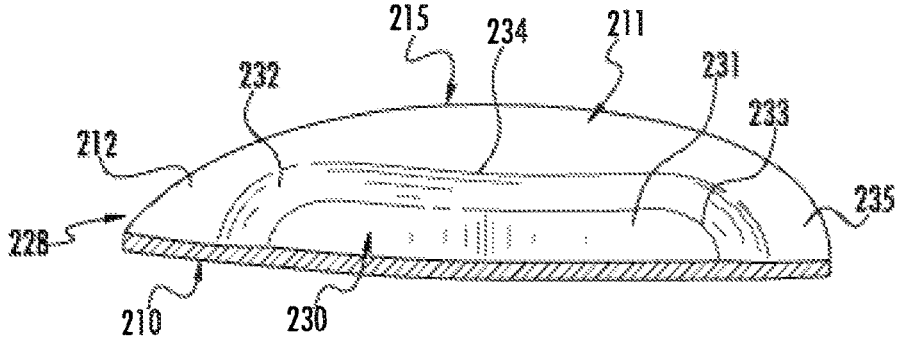
FIG. 11 is a cross-section view taken along lines 11-11 of FIG. 9.
Figure 12:
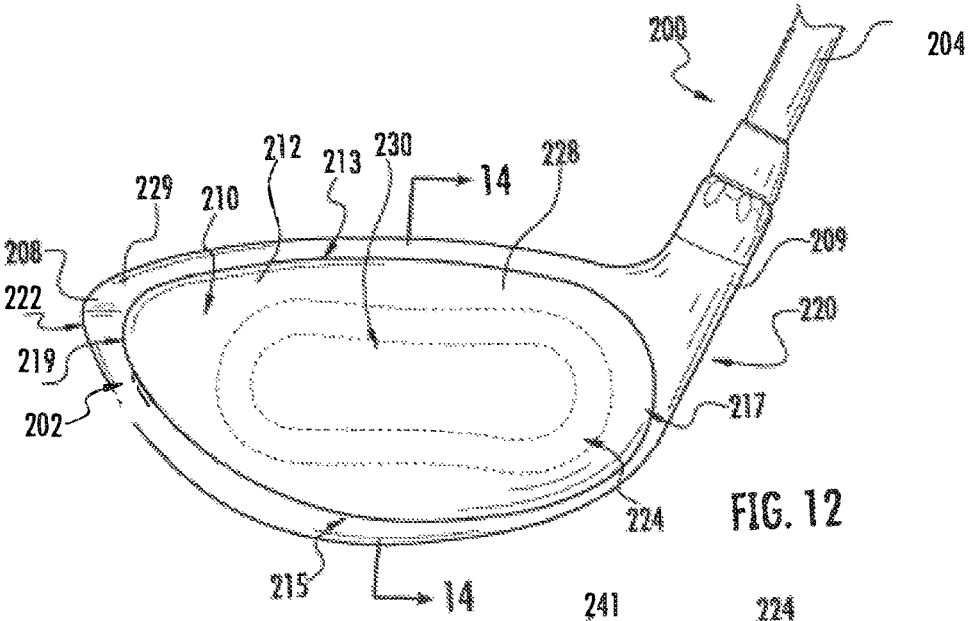
FIG. 12 is a front view of another embodiment of a head of a ball striking device according to aspects of the invention, including the face of FIG. 9.

Additionally, in the embodiment illustrated in FIGS. 9-14, the shape(s) defined by the edges 233, 234 of the tapered area 232, including the shapes of the plateau area 231 and the elevated area 236, are elongated along an axis of elongation (e.g., generally horizontal in FIG. 9). In this embodiment, the lobes 237 each have dimensions measured along a second axis perpendicular to the axis of elongation (e.g., generally vertical in FIG. 9), and the lobes 237 have greater dimensions perpendicular to the axis of elongation than the connecting area 238, which is narrowed with respect to the lobes 237.

In one embodiment of the face 212 illustrated in FIGS. 9-14, the inner surface 211 of the face plate 228 has a total area of approximately 3235 $mm^2$, with the plateau area 231 having an area of approximately 814 $mm^2$, the tapered area 231 having an area of approximately 884 $mm^2$, and the peripheral area 235 having an area of approximately 1537 $mm^2$. Additionally, in one embodiment of the face 212 illustrated in FIGS. 9-14, the plateau area 231 has a generally constant thickness of approximately 3.3 mm and the peripheral area 235 has a generally constant thickness of approximately 2.7 mm. In an alternate embodiment, where the plateau area 231 and/or the peripheral area do not have a generally constant thickness, the maximum thickness of the plateau area 231 is approximately 3.3 mm, and the minimum thickness of the peripheral area 235 is approximately 2.7 mm. It is understood that in one embodiment, the thicknesses of these various portions of the face 212 may be increased or decreased, while maintaining the same or approximately the same relative differences in thickness, either as a proportion or an absolute difference.

Figure 15:
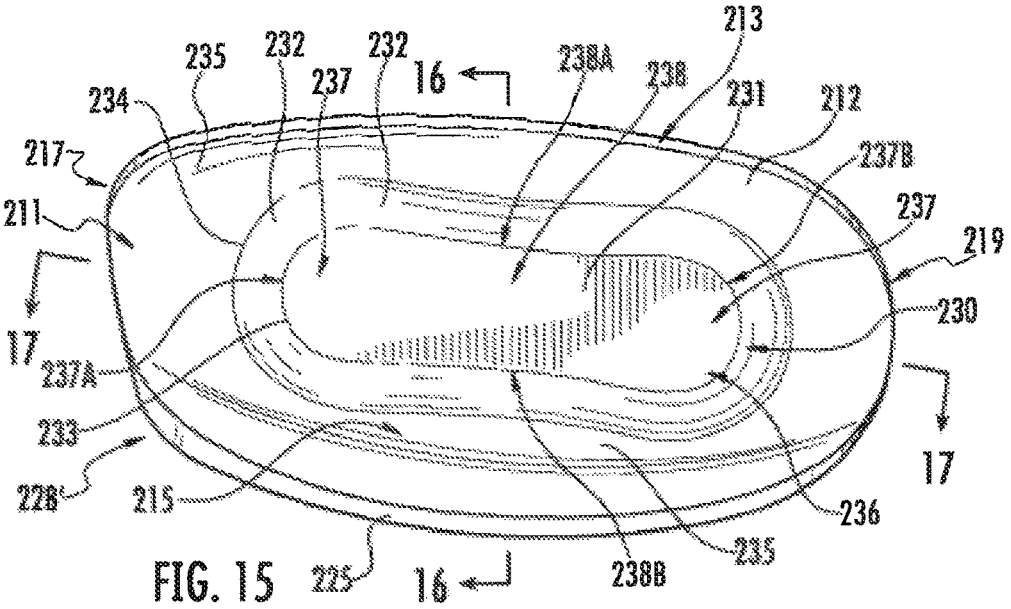
FIG. 15 is another embodiment of a face for a head of a ball striking device.
Figure 16:
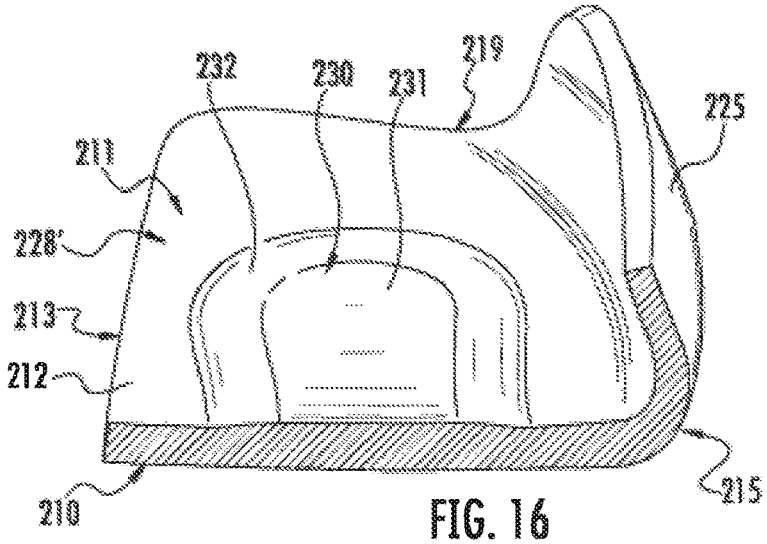
FIG. 16 is a cross-section view taken along lines 16-16 of FIG. 15.
Figure 17:
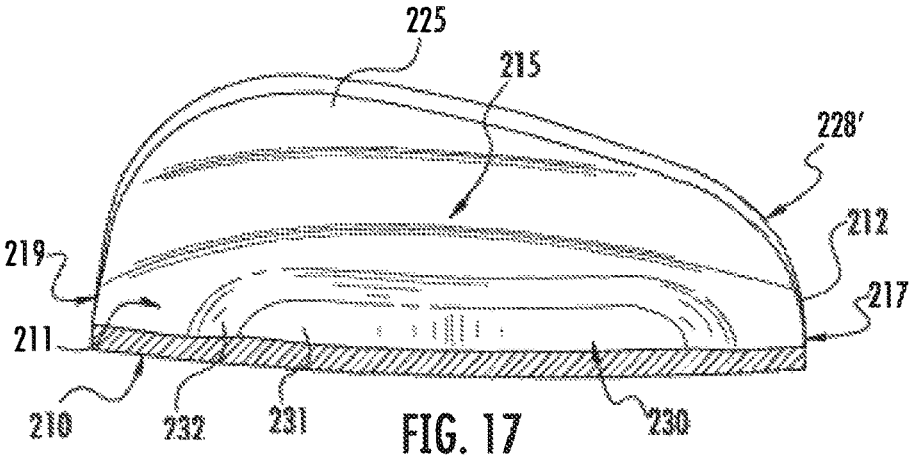
FIG. 17 is a cross-section view taken along lines 17-17 of FIG. 15.
Figure 18:
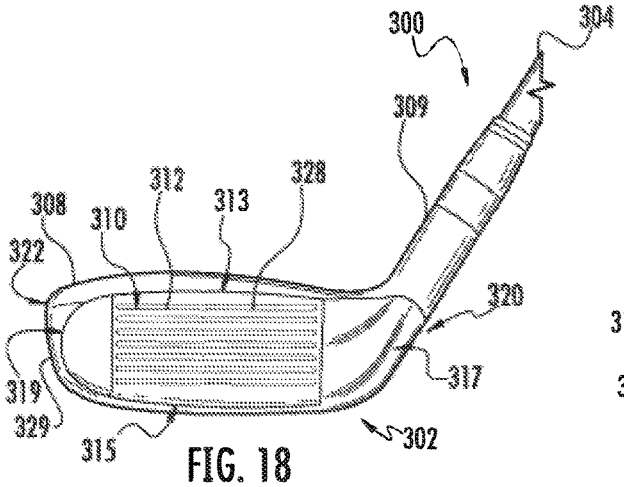
FIG. 18 is a front view of another embodiment of a head of a ball striking device according to aspects of the invention, in the form of a hybrid golf club head.
Figure 19:
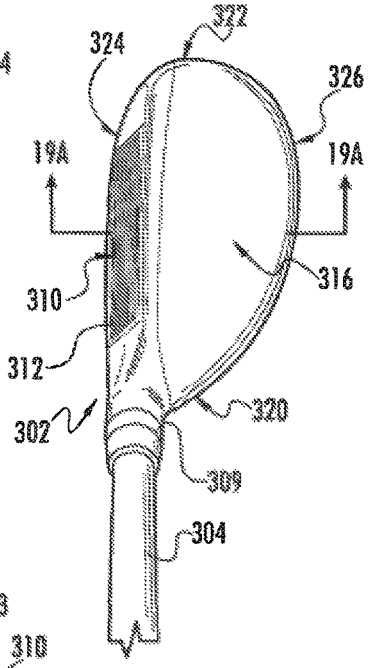
FIG. 19 is a top view of the head of FIG. 18.
Figure 19A:
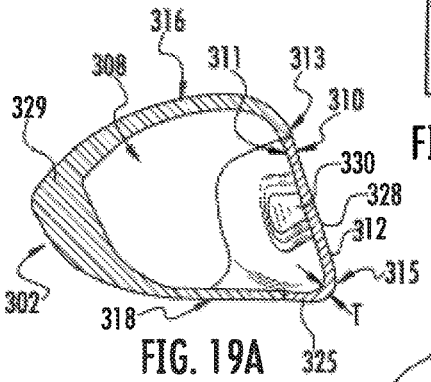
FIG. 19A is a cross-section view taken along lines 19A-19A of FIG. 19.
Figure 20:
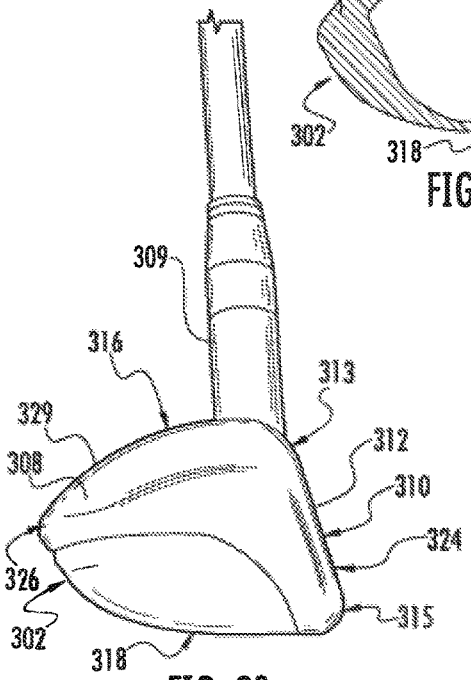
FIG. 20 is a side view of the head of FIG. 18.
Figure 21:
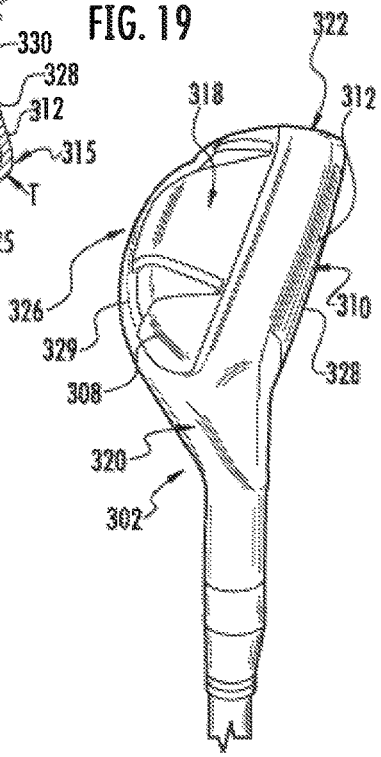
FIG. 21 is a bottom perspective view of the head of FIG. 18.

In the embodiment illustrated in FIGS. 9-14, the face 212 is formed by a face plate 228 and the body is at least partially formed by a body member 229 (or multiple body members) connected to the face plate 228 and extending rearward from the face plate 228. The face plate 228 may be defined by peripheral edges that correspond to the peripheral edges 213, 215, 217, 219 of the face 212. In other embodiments, the face 212 may be formed by a cup-face structure, an L-face structure, or other structure. For example, FIGS. 15-17 illustrate one embodiment of an L-shaped face member 228' that includes a face 212 as described above and shown in FIGS. 9-14, with a wall 225 extending transverse and rearward from the bottom edge 215 of the face 212. The configuration of the thickened portion 230 and the relative areas and thicknesses of the face 212 are the same in the embodiment of FIGS. 15-17 as in FIGS. 9-14. However, the area of the peripheral area 235 and the total area of the inner surface 211 of the face 212 may be different based on slight differences in peripheral shape. The face member 228' may have one or more body members connected to the wall 225 and the other edges 213, 217, 219 of the face 212, similar to the configurations illustrated in FIGS. 18-31 and described below. In this configuration, the body member(s) may form the body 208 of the ball striking device 202, and the wall 225 may form a portion of the sole 218 of the body 208. In a further embodiment, the face 212 may be formed as part of an inverted L-shaped face member (not shown), which may have a wall extending rearward from the top edge 213 of the face 212 and forming a portion of the crown 216 of the body 208.

Figure 13:
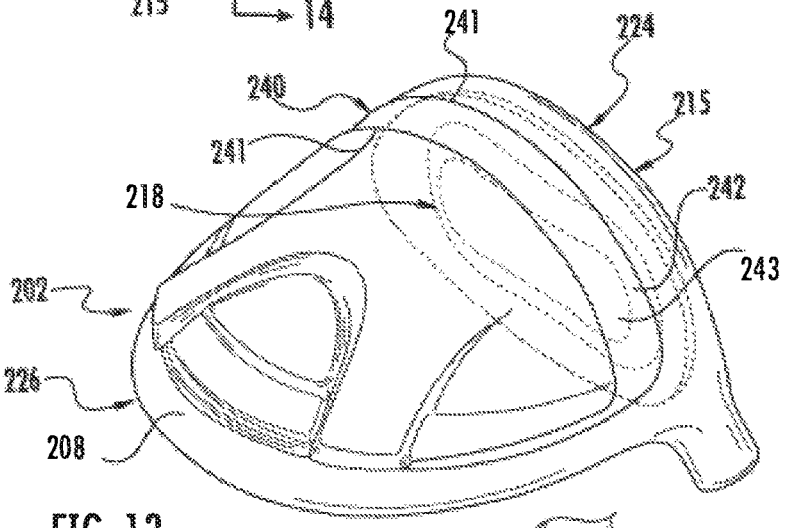
FIG. 13 is a bottom perspective view of the head of FIG. 12.
Figure 14:
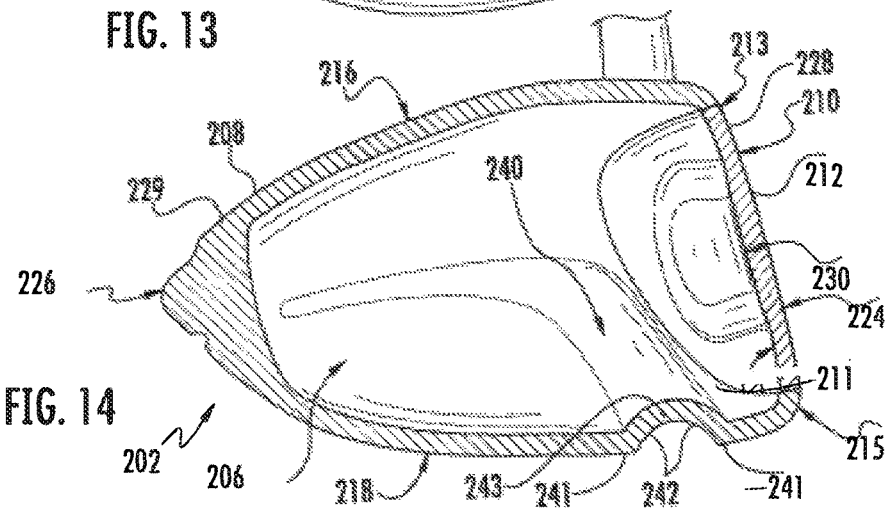
FIG. 14 is a cross-section view taken along lines 14-14 of FIG. 13.

Additionally, as shown in FIGS. 13-14, the body 208 of the head 202 of this embodiment has an inwardly recessed or indented channel 240 extending across the sole 218. The channel 240 is spaced rearwardly from the bottom edge 215 of the face 212 and extends generally parallel to at least a portion of the bottom edge 215 of the face 212. The channel 240 in this embodiment includes boundary edges 241 with curvilinear walls 242 depending from the boundary edges 241 to form an inwardly recessed trough 243 with a curvilinear profile. In other embodiments, the body 208 may include multiple channels and/or differently configured channels, and may include a channel with a more rectangular profile or an insert within the channel in different embodiments. Several examples of different channel configurations that may be used with the head 202 of FIGS. 9-14 (or other heads described herein) are shown and described in U.S. patent application Ser. No. 12/842,650, filed Jul. 23, 2010; U.S. patent application Ser. No. 13/015,264, filed Jan. 27, 2011; U.S. Pat. No. 6,887,165, issued May. 3, 2005; and U.S. Pat. No. 7,294,064, issued Nov. 13, 2007, all of which are incorporated by reference herein in their entireties and made part hereof. Other features of the head 202 may be similar to those described above with respect to FIGS. 1-8.

FIGS. 18-24 illustrate another embodiment of a ball striking device 300 and a ball striking head 302 in the form of a hybrid golf club. The embodiment of the ball striking device 300 illustrated in FIGS. 18-24 contains features similar to those of the embodiments described above with respect to FIGS. 1-17, and similar components in the embodiment of FIGS. 18-24 are similarly referred to using the "3xx" series of reference numbers. It is understood that discussion of some features of the embodiment of FIGS. 18-24 that have already been described above may be reduced or eliminated in the interests of brevity. As described above, the head 302 includes a face 312 with a body 308 extending rearward from the face 312. The face 312 and the body 308 are configured for use as a hybrid-type club, and accordingly, may have a smaller volume and a different shape from the wood-type ball striking devices 100, 200 of FIGS. 1-17. In another embodiment, the body 308 of a hybrid-type head 302 may be provided with one or more channels, such as described above with respect to the head 202 of FIGS. 9-14.

In this embodiment, the face 312 includes a thickened portion 330 on the inner surface 311 of the face 312, extending inwardly to create a protrusion on the inner surface 311 of the face 312. The thickened portion 330 has a greater thickness than surrounding areas of the face 312 and a greater thickness than any other portion of the face 312. In one embodiment, the thickened portion 330 has at least one plateau area 331 having a generally constant thickness, and at least one tapered area 332 having a tapering thickness that increases or decreases between boundary edges 333, 334. In the embodiment illustrated in FIGS. 18-24, the thickened portion 330 includes a single plateau area 331 that is bounded and defined completely by an annular tapered area 332 that has an upper or inner edge or boundary 333 defining the outer edge of the plateau area 331 and a lower or outer edge or boundary 334. The plateau area 331 has a generally constant thickness that is the maximum face thickness of the entire face 312. The thickness of the tapered area 332 decreases from the inner edge 333 to the outer edge 334. In the embodiment shown in FIGS. 18-24, the tapered area 332 has a generally curvilinear taper. The face 312 has a generally constant thickness at the outer edge 334 of the tapered area 332, and the peripheral area 335 surrounding the tapered area 332 has a generally constant thickness.

In one embodiment, at least one of the inner and outer edges 333, 334 of the annular tapered area 332 defines outer edges of a shape that includes a first lobe 337, where the outer edge 337A has a convex outer profile, a second lobe 337, where the outer edge 337B has a convex outer profile, and a connecting portion 338 extending between the lobes 337, such that the connecting portion 338 is defined by outer edges 338A-B extending between the outer edges 337A-B of the first and second lobes 337, with at least one of the outer edges 338A-B of the connecting portion 338 having a concave profile. In the embodiment shown in FIGS. 18-24, both the inner and outer edges 333, 334 of the tapered area 332 define a peanut shape, with the upper and lower edges 338A-B of the connecting portion 338 having concave profiles. Because the inner edge 333 of the tapered area 332 forms the outer edge of the plateau area 331, the outer edge of the plateau area 331 also defines a peanut shape as described above. Further, either or both of the inner and outer edges 333, 334 of the tapered area 332 may be considered to define an elevated area 336 that has a greater face thickness than the surrounding areas of the face and has an outer edge defining a peanut shape as described above.

Figure 22:
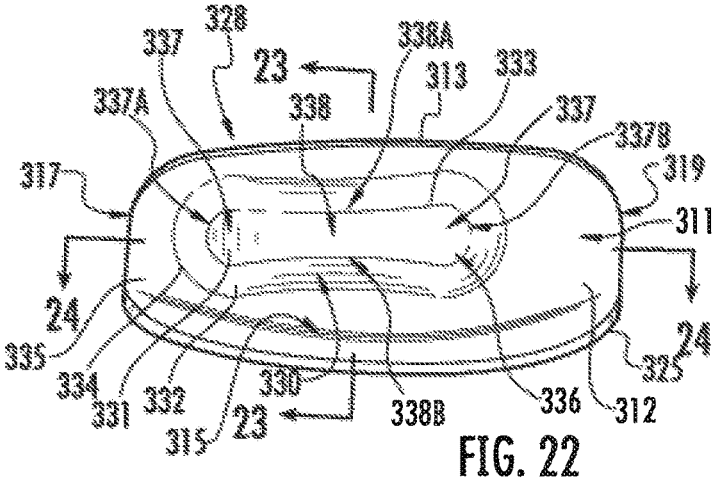
FIG. 22 is a rear view of a face of the head of FIG. 18.
Figure 23:
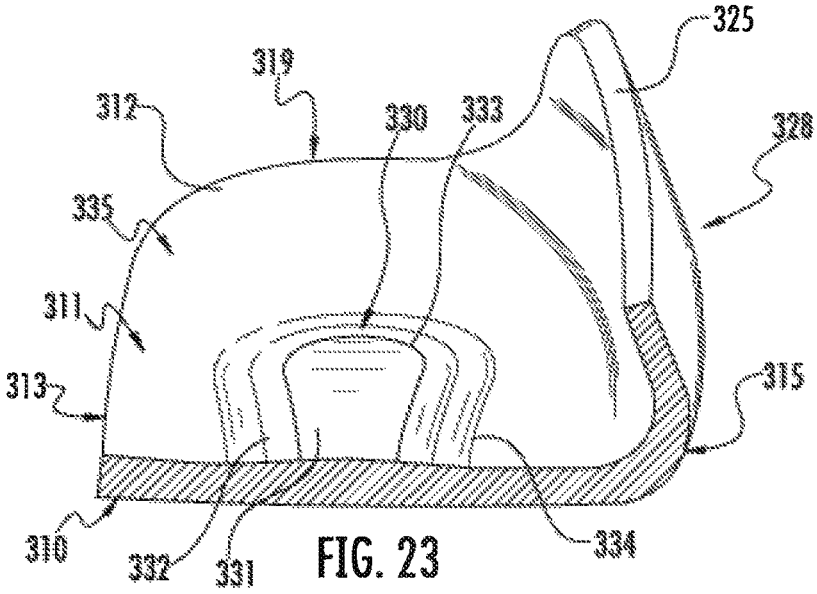
FIG. 23 is a cross-section view taken along lines 23-23 of FIG. 22.
Figure 24:
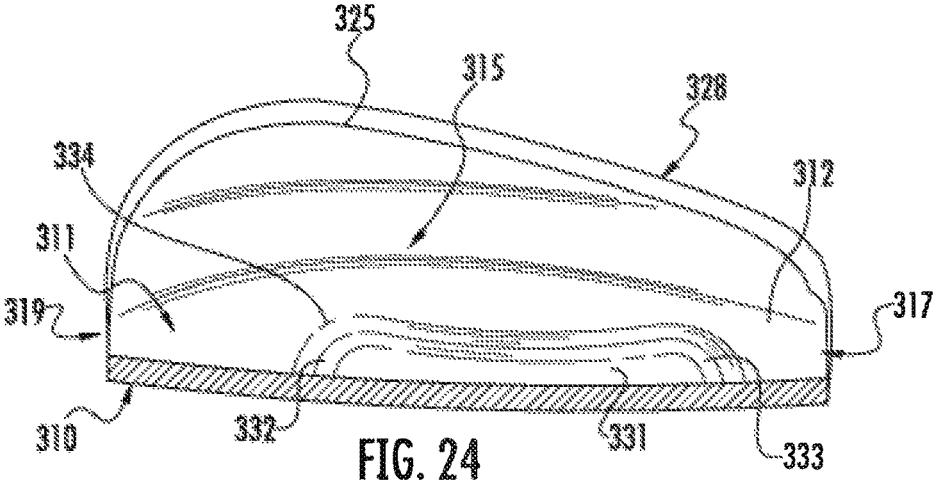
FIG. 24 is a cross-section view taken along lines 24-24 of FIG. 22.
Figure 25:
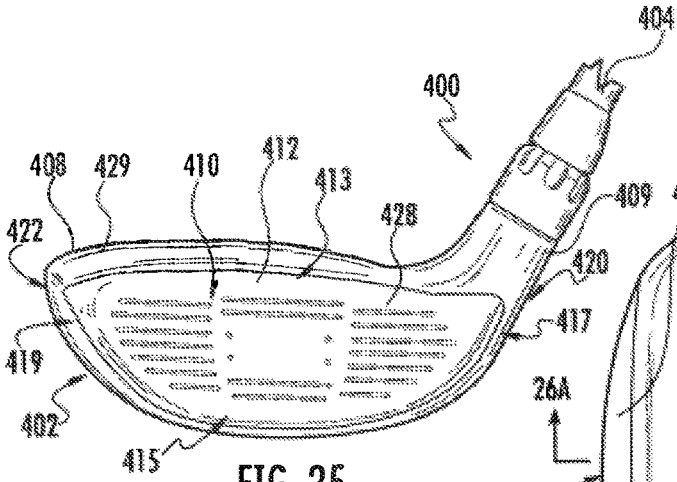
FIG. 25 is a front view of another embodiment of a head of a ball striking device according to aspects of the invention, in the form of a fairway wood golf club head.
Figure 26:
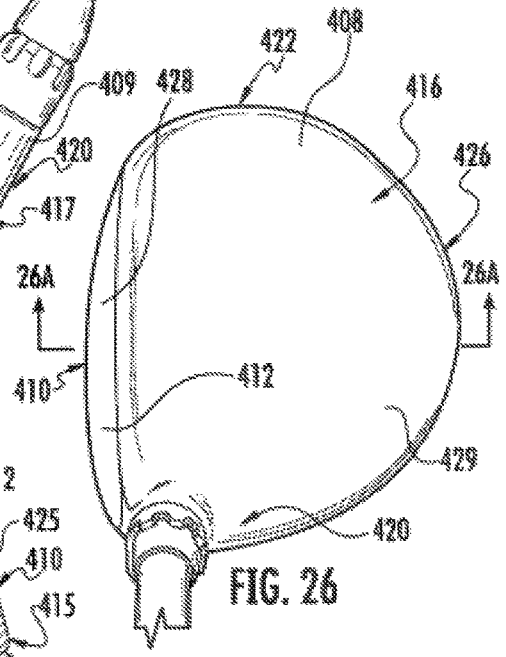
FIG. 26 is a top view of the head of FIG. 25.
Figure 26A:
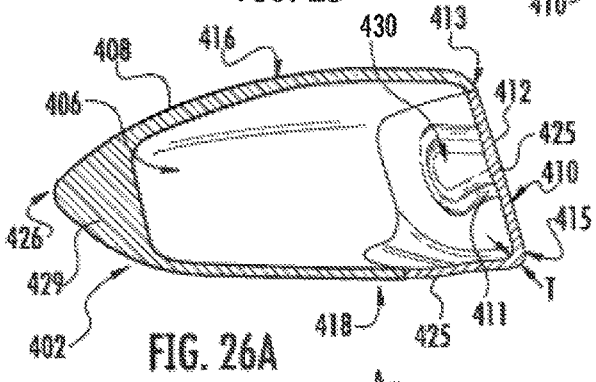
FIG. 26A is a cross-section view taken along lines 26A-26A of FIG. 26.
Figure 27:
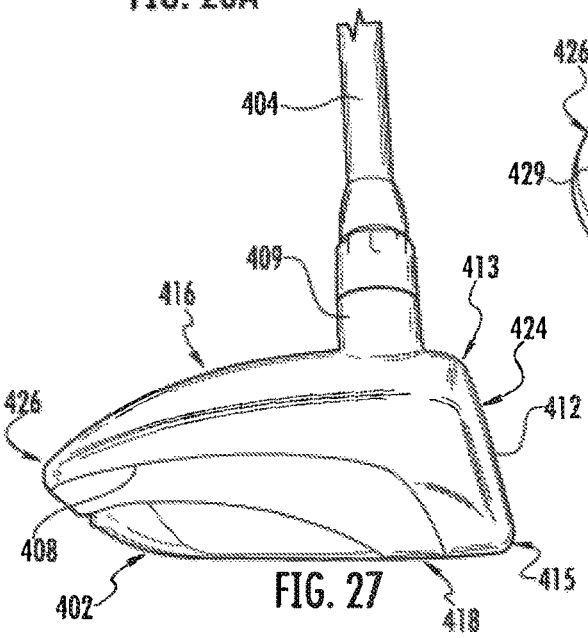
FIG. 27 is a side view of the head of FIG. 25.
Figure 28:
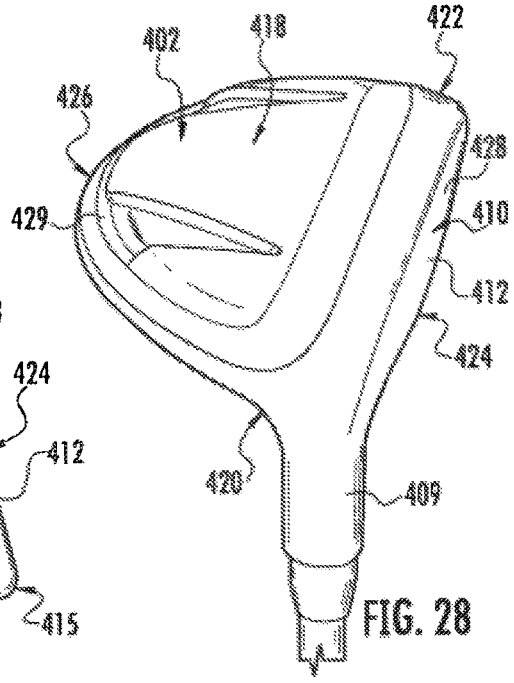
FIG. 28 is a bottom perspective view of the head of FIG. 25.
Figure 29:
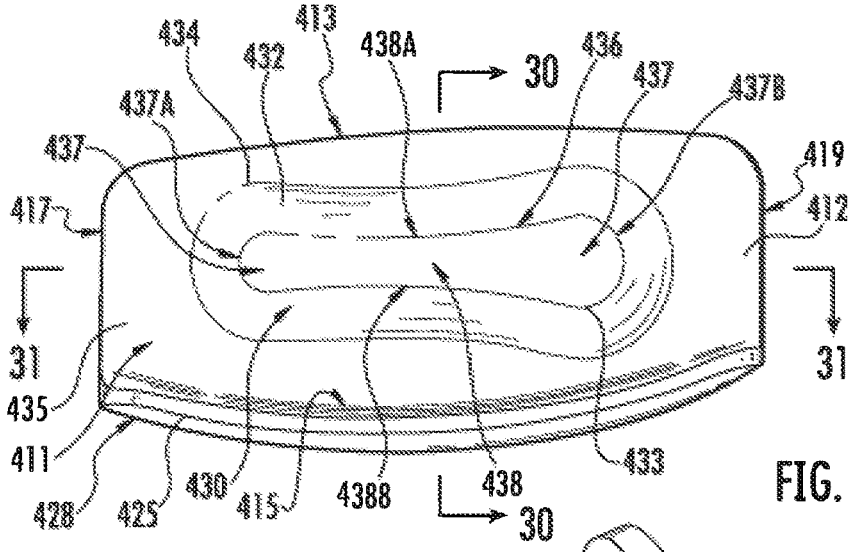
FIG. 29 is a rear view of a face of the head of FIG. 25.

Additionally, in the embodiment illustrated in FIGS. 18-24, the shape(s) defined by the edges 333, 334 of the tapered area 332, including the shapes of the plateau area 331 and the elevated area 336, are elongated along an axis of elongation (e.g., generally horizontal in FIG. 22). In this embodiment, the lobes 337 each have dimensions measured along a second axis perpendicular to the axis of elongation (e.g., generally vertical in FIG. 22), and the lobes 337 have greater dimensions perpendicular to the axis of elongation than the connecting area 338, which is narrowed with respect to the lobes 337.

In one embodiment of the face 312 illustrated in FIGS. 18-24, the inner surface 311 of the face plate 328 has a total area of approximately 1920 $mm^2$, with the plateau area 331 having an area of approximately 217 $mm^2$, the tapered area 331 having an area of approximately 405 $mm^2$, and the peripheral area 335 having an area of approximately 1297 $mm^2$. Additionally, in one embodiment of the face 312 illustrated in FIGS. 18-24, the plateau area 331 has a generally constant thickness of approximately 1.9 mm, and the peripheral area 335 has a generally constant thickness of approximately 1.6 mm. In another embodiment, the plateau area 331 has a generally constant thickness of approximately 3 mm, and the peripheral area 335 has a generally constant thickness of approximately 2 mm. In an alternate embodiment, where the plateau area 331 and/or the peripheral area do not have a generally constant thickness, the maximum thickness of the plateau area 331 is approximately 1.9 mm or approximately 3 mm, and the minimum thickness of the peripheral area 335 is approximately 1.6 mm or approximately 2 mm. It is understood that in one embodiment, the thicknesses of these various portions of the face 312 may be increased or decreased, while maintaining the same or approximately the same relative differences in thickness, either as a proportion or an absolute difference.

In the embodiment illustrated in FIGS. 18-24, the face 312 is formed by an L-shaped face member 328 that includes the face 312 and a wall 325 extending transverse and rearward from the bottom edge 315 of the face 312, as similarly described above. The body 308 is at least partially formed by one or more body members 329 connected to the face member 328 and extending rearwardly from the face member 328. For example, the body member(s) 329 may be connected to the wall 325 and the other edges 313, 317, 319 of the face 312, such as by welding. In this configuration, the wall 325 may form a portion of the sole 318 of the body 308. In another embodiment, the face 312 may be formed as part of an inverted L-shaped face member (not shown), which may have a wall extending rearward from the top edge 313 of the face 312 and forming a portion of the crown 316 of the body 308. In further embodiments, the face 312 may be formed as a face plate, a cup-face structure, or another configuration.

FIGS. 25-31 illustrate another embodiment of a ball striking device 400 and a ball striking head 402 in the form of a fairway wood golf club. The embodiment of the ball striking device 400 illustrated in FIGS. 25-31 contains features similar to those of the embodiments described above with respect to FIGS. 1-24, and similar components in the embodiment of FIGS. 25-31 are similarly referred to using the "4xx" series of reference numbers. It is understood that discussion of some features of the embodiment of FIGS. 25-31 that have already been described above may be reduced or eliminated in the interests of brevity. As described above, the head 402 includes a face 412 with a body 408 extending rearward from the face 412. The face 412 and the body 408 are configured for use as a fairway wood-type club, and accordingly, may have a different volume and a different shape from the driver wood-type ball striking devices 100, 200 or the hybrid-type ball striking device 300, described in FIGS. 1-24. In another embodiment, the body 408 of a fairway wood-type head 402 may be provided with one or more channels, such as described above with respect to the head 202 of FIGS. 9-14.

In this embodiment, the face 412 includes a thickened portion 430 on the inner surface 411 of the face 412, extending inwardly to create a protrusion on the inner surface 411 of the face 412. The thickened portion 430 has a greater thickness than surrounding areas of the face 412 and a greater thickness than any other portion of the face 412. In one embodiment, the thickened portion 430 has at least one plateau area 431 having a generally constant thickness, and at least one tapered area 432 having a tapering thickness that increases or decreases between boundary edges 433, 434. In the embodiment illustrated in FIGS. 25-31, the thickened portion 430 includes a single plateau area 431 that is bounded and defined completely by an annular tapered area 432 that has an upper or inner edge or boundary 433 defining the outer edge of the plateau area 431 and a lower or outer edge or boundary 434. The plateau area 431 has a generally constant thickness that is the maximum face thickness of the entire face 412. The thickness of the tapered area 432 decreases from the inner edge 433 to the outer edge 434. In the embodiment shown in FIGS. 25-31, the tapered area 432 has a generally curvilinear taper. The face 412 has a generally constant thickness at the outer edge 434 of the tapered area 432, and the peripheral area 435 surrounding the tapered area 432 has a generally constant thickness.

In one embodiment, at least one of the inner and outer edges 433, 434 of the annular tapered area 432 defines outer edges of a shape that includes a first lobe 437, where the outer edge 437A has a convex outer profile, a second lobe 437, where the outer edge 437B has a convex outer profile, and a connecting portion 438 extending between the lobes 437, such that the connecting portion 438 is defined by outer edges 438A-B extending between the outer edges 437A-B of the first and second lobes 437, with at least one of the outer edges 438A-B of the connecting portion 438 having a concave profile. In the embodiment shown in FIGS. 25-31, both the inner and outer edges 433, 434 of the tapered area 432 define a peanut shape, with the upper and lower edges 438A-B of the connecting portion 438 having concave profiles. Because the inner edge 433 of the tapered area 432 forms the outer edge of the plateau area 431, the outer edge of the plateau area 431 also defines a peanut shape as described above. Further, either or both of the inner and outer edges 433, 434 of the tapered area 432 may be considered to define an elevated area 436 that has a greater face thickness than the surrounding areas of the face and has an outer edge defining a peanut shape as described above.

Figure 30:
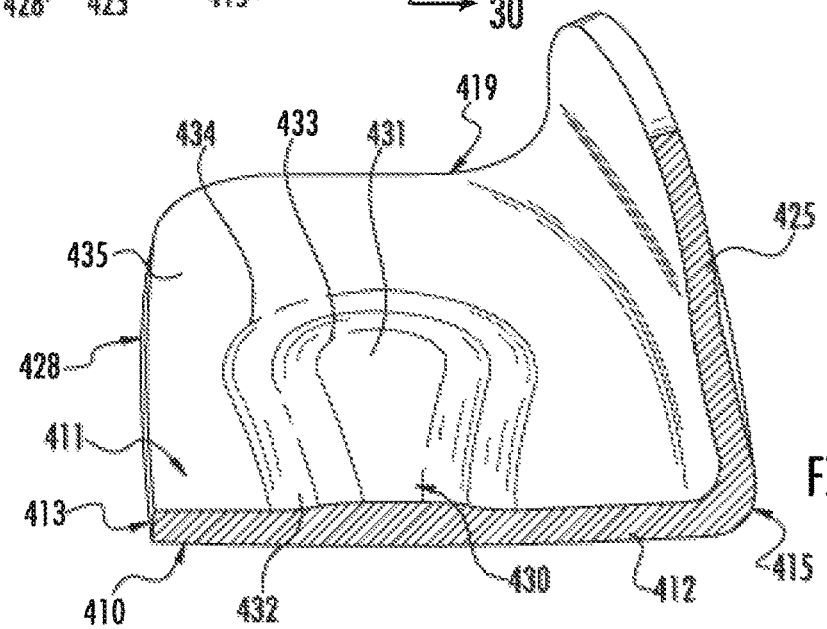
FIG. 30 is a cross-section view taken along lines 30-30 of FIG. 25.
Figure 31:
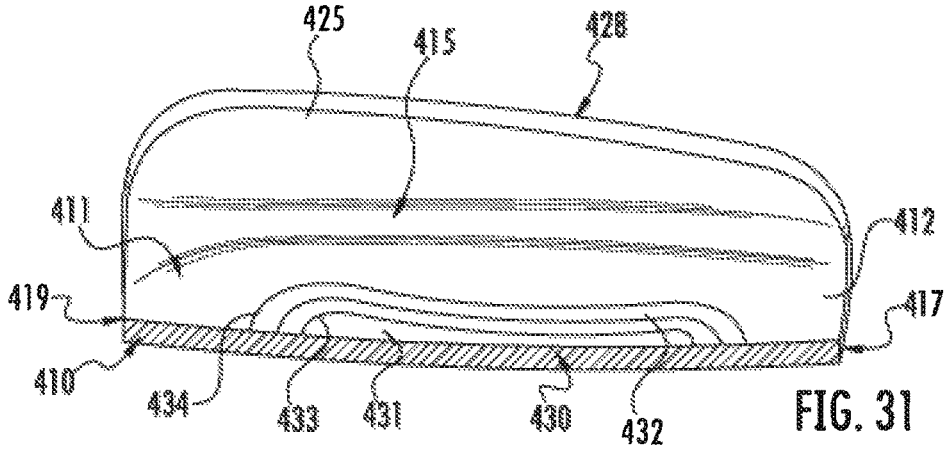
FIG. 31 is a cross-section view taken along lines 31-31 of FIG. 25.

Additionally, in the embodiment illustrated in FIGS. 25-31, the shape(s) defined by the edges 433, 434 of the tapered area 432, including the shapes of the plateau area 431 and the elevated area 436, are elongated along an axis of elongation (e.g., generally horizontal in FIG. 30). In this embodiment, the lobes 437 each have dimensions measured along a second axis perpendicular to the axis of elongation (e.g., generally vertical in FIG. 30), and the lobes 437 have greater dimensions perpendicular to the axis of elongation than the connecting area 438, which is narrowed with respect to the lobes 437.

In one embodiment of the face 412 illustrated in FIGS. 25-31, the inner surface 411 of the face plate 428 has a total area of approximately 1900 $mm^2$, with the plateau area 431 having an area of approximately 188 $mm^2$, the tapered area 431 having an area of approximately 415 $mm^2$, and the peripheral area 435 having an area of approximately 1297 $mm^2$. Additionally, in one embodiment of the face 412 illustrated in FIGS. 25-31, the plateau area 431 has a generally constant thickness of approximately 2.1 mm, and the peripheral area 435 has a generally constant thickness of approximately 1.6 mm. In another embodiment, the plateau area 431 has a generally constant thickness of approximately 3 mm, and the peripheral area 435 has a generally constant thickness of approximately 2 mm. In an alternate embodiment, where the plateau area 431 and/or the peripheral area do not have a generally constant thickness, the maximum thickness of the plateau area 431 is approximately 2.1 mm or approximately 3 mm, and the minimum thickness of the peripheral area 435 is approximately 1.6 mm or approximately 2 mm. It is understood that in one embodiment, the thicknesses of these various portions of the face 412 may be increased or decreased, while maintaining the same or approximately the same relative differences in thickness, either as a proportion or an absolute difference.

In the embodiment illustrated in FIGS. 25-31, the face 412 is formed by an L-shaped face member 428 that includes the face 412 and a wall 425 extending rearward from the bottom edge 415 of the face 412, as similarly described above. The body 408 is at least partially formed by one or more body members 429 connected to the face member 428 and extending rearwardly from the face member 428. For example, the body member(s) 429 may be connected to the wall 425 and the other edges 413, 417, 419 of the face 412, such as by welding. In this configuration, the wall 425 may form a portion of the sole 418 of the body 408. In another embodiment, the face 412 may be formed as part of an inverted L-shaped face member (not shown), which may have a wall extending rearward from the top edge 413 of the face 412 and forming a portion of the crown 416 of the body 408. In further embodiments, the face 412 may be formed as a face plate, a cup-face structure, or another configuration.

In the embodiments of the head 302 shown in FIGS. 18-24 and the head 402 shown in FIGS. 25-31, the L-shaped face member 328, 428 assists with achieving a more gradual impact with a ball struck on the face 312, 412, in order to limit deformation of the ball and thereby limit energy and velocity loss during impact. The face member 328, 428 can be made more flexible to increase deformation of the face 312, 412, while the thickened portion 330, 430 assists in retaining stiffness in the face 312, 412. For example, the face member 328, 428 can be formed with a smaller than normal thickness at or around the junction between the face 312, 412 and the wall 325, 425 to increase flexibility. In one embodiment, this thickness (indicated by T in FIGS. 23 and 30) can be between 1-2 mm, and in another embodiment, the thickness T can be between 1-2.5 mm, which are comparatively thinner than the corresponding thicknesses T of standard golf club faces. The face member 328, 428 may be advantageously formed of a high-strength material to allow deformation of the face 312, 412 without unacceptable risk of breakage. In one embodiment, the face member 328, 428 may be formed of high-strength Carpenter 455 or 465 stainless steel, while the body 308, 408 is formed of 17-4 stainless steel. Other embodiments described herein may incorporate these same materials Alternate materials that may be used for the body member 329, 429 and/or the face member 312, 412 in these embodiments and other embodiments herein include high strength titanium, PEEK polymer with or without fiber reinforcement, amorphous liquid metals, bulk modulus composites, etc.

FIGS. 32-36 illustrate a ball striking device 500 in the form of a golf iron, in accordance with at least some examples of this invention. The embodiment of the iron-type ball striking device 500 illustrated in FIGS. 32-36 contains features similar to those of the embodiments described above with respect to FIGS. 1-31, and similar components in the embodiment of FIGS. 32-36 are similarly referred to using the "5xx" series of reference numbers. It is understood that discussion of some features of the embodiment of FIGS. 32-36 that have already been described above may be reduced or eliminated in the interests of brevity. The ball striking device 500 includes a golf club head 502 and a shaft 504 attached to the head 502. The golf club head 502 of FIGS. 32-36 may be representative of any iron-type golf club head in accordance with examples of the present invention.

As shown in FIGS. 32-36, the golf club head 502 includes a face 512 connected to a body 508 and a hosel 509 extending from the body 508 for attachment of the shaft 504. The shaft 504, and the connection between the shaft 504 and the hosel 509 may be similar to that described above with respect to the device 100 of FIGS. 1-8. The shaft 504 may also include a grip (not shown) as described above. For reference, the head 502 generally has a top 516, a bottom or sole 518, a heel 520 proximate the hosel 509, and a toe 522 distal from the hosel 509, as well as a front 524 and a back or rear 526. In the embodiment shown, the face 512 extends upward from the sole 518 of the head 502. The shape and design of the head 502 may be partially dictated by the intended use of the device 500. The heel portion 520 is attached to and/or extends from a hosel 509 (e.g., as a unitary or integral one piece construction, as separate connected elements, etc.).

Figure 35:
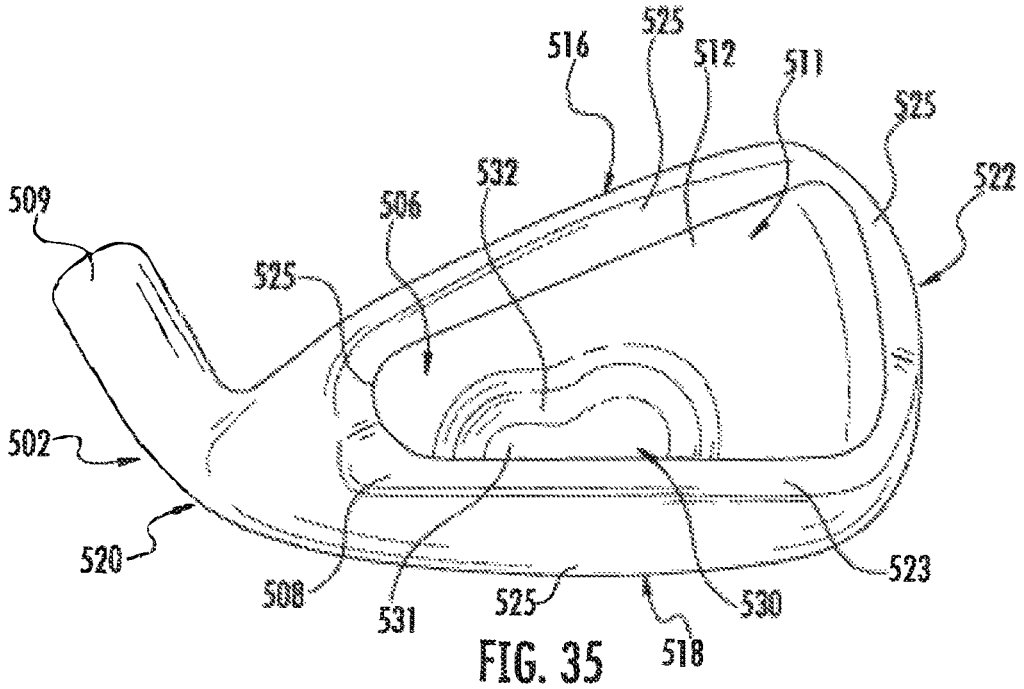
FIG. 35 is a rear view of the head of FIG. 32.
Figure 36:
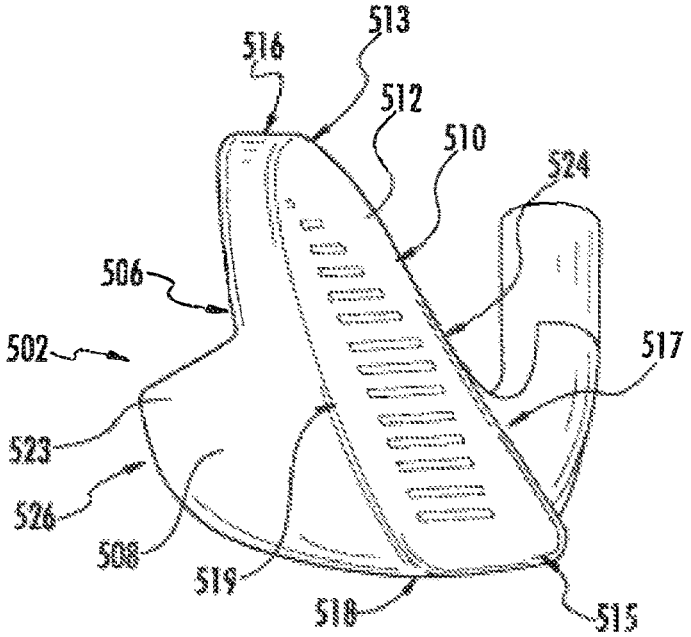
FIG. 36 is a side view of the head of FIG. 32.

The face 512 is located at the front 524 of the head 502, and has a ball striking surface 510 located thereon and a rear or inner surface 511 (See FIGS. 33-35) opposite the ball striking surface 510. The head 502 has a rear cavity 506 that is defined by the rear surface 511 of the face 512, one or more walls 525 extending rearward from the face 512, and a rear wall 523 extending upward from the sole 518 at the rear 526 of the head 502. As seen in FIGS. 33 and 35, the rear wall 523 leaves the rear cavity 511 partially open in this embodiment, however the rear cavity 511 may be closed or may be open to a greater degree in other embodiments. It is understood that in some embodiments of an iron-type golf club 500, the rear surface 511 of the face 512 may be a surface of the body 508, such as when the head 502 has no internal cavity. In another embodiment, the body 508 of an iron-type head 502 may be provided with one or more channels, such as described above with respect to the head 202 of FIGS. 9-14.

The ball striking surface 510 is typically an outer surface of the face 512 configured to face a ball (not shown) in use, and is adapted to strike the ball when the device 500 is set in motion, such as by swinging. As shown, the ball striking surface 510 is relatively flat, occupying most of the face 512. The ball striking surface 510 may include grooves 521 (e.g., generally horizontal grooves 521 extending across the face 512 in the illustrated example) for the removal of water and grass from the face 512 during a ball strike. Of course, any number of grooves, desired groove patterns, and/or groove constructions may be provided (or even no groove pattern, if desired), including conventional groove patterns and/or constructions, without departing from this invention.

For reference purposes, the portion of the face 512 nearest the top face edge 513 and the heel face edge 517 is referred to as the "high-heel area"; the portion of the face 512 nearest the top face edge 513 and the toe face edge 519 is referred to as the "high-toe area"; the portion of the face 512 nearest the bottom face edge 515 and the heel face edge 517 is referred to as the "low-heel area"; and the portion of the face 512 nearest the bottom face edge 515 and the toe face edge 519 is referred to as the "low-toe area". Conceptually, these areas may be recognized and referred to as quadrants of substantially equal size (and/or quadrants extending from a geometric center of the face 512), though not necessarily with symmetrical dimensions. The face 512 may include some curvature in the top to bottom and/or heel to toe directions (e.g., bulge and roll characteristics), as is known and is conventional in the art. In other embodiments, the surface 510 may occupy a different proportion of the face 512, or the body 508 may have multiple ball striking surfaces 510 thereon. In the illustrative embodiment shown in FIGS. 32-36, the ball striking surface 510 is inclined (i.e., at a loft angle), to give the ball an appreciable degree of lift and spin when struck. In other illustrative embodiments, the ball striking surface 510 may have a different incline or loft angle, to affect the trajectory of the ball. Additionally, the face 512 may have a variable thickness and/or may have one or more internal or external inserts in some embodiments.

The face 512, the body 508, and/or the hosel 509 can be formed as a single piece or as separate pieces that are joined together. For example, the face 512, the body 508, and the hosel 509 can be formed together as a single piece by forging, casting, or other integral forming techniques. As another example, the face 512, the body 508, and the hosel 509 can be formed as separate pieces, such as a face member and a body member, which can be joined together by an integral joining technique, such as welding, or other joining technique. In one embodiment, a face member of a multi-piece head 502 may be in the form of a face plate, an L-shaped face member, a cup-face member, or another form. In another embodiment, a set of golf irons may have structures as described herein and shown in FIGS. 32-36, with the longer irons (e.g. 4-7) being formed of two pieces, including a face plate and a body member joined by welding, and the shorter irons (e.g. 8, 9, P, S, A) being formed of a cast or forged single piece. In this embodiment, the single piece head and/or the body member may be made from 17-4 stainless steel, and the face plate member may be formed of 455 or 465 stainless steel, or other materials may be used.

In this embodiment, the face 512 includes a thickened portion 530 on the inner surface 511 of the face 512, extending inwardly to create a protrusion on the inner surface 511 of the face 512. The thickened portion 530 has a greater thickness than surrounding areas of the face 512 and a greater thickness than any other portion of the face 512. The thickened portion 530 is more proximate the bottom edge 515 of the face 512 than the top edge 513 in the embodiment illustrated, and in one embodiment, the center of the thickened portion 530 is approximately 15-22 mm from the bottom edge 515 of the face 512. This distance may be different in other embodiments, and in one embodiment, different clubs within a set may have different spacing between the thickened portion 530 and the bottom edge 515 of the face 512.

In one embodiment, the thickened portion 530 has at least one plateau area 531 having a generally constant thickness, and at least one tapered area 532 having a tapering thickness that increases or decreases between boundary edges 533, 534. In the embodiment illustrated in FIGS. 32-36, the thickened portion 530 includes a single plateau area 531 that is bounded and defined completely by an annular tapered area 532 that has an upper or inner edge or boundary 533 defining the outer edge of the plateau area 531 and a lower or outer edge or boundary 534. The plateau area 531 has a generally constant thickness that is the maximum face thickness of the entire face 512. The thickness of the tapered area 532 decreases from the inner edge 533 to the outer edge 534. In the embodiment shown in FIGS. 32-36, the tapered area 532 has a generally curvilinear taper. The face 512 has a generally constant thickness at the outer edge 534 of the tapered area 532, and the peripheral area 535 surrounding the tapered area 532 has a generally constant thickness.

In one embodiment, at least one of the inner and outer edges 533, 534 of the annular tapered area 532 defines outer edges of a shape that includes a first lobe 537, where the outer edge 537A has a convex outer profile, a second lobe 537, where the outer edge 537B has a convex outer profile, and a connecting portion 538 extending between the lobes 537, such that the connecting portion 538 is defined by outer edges 538A-B extending between the outer edges 537A-B of the first and second lobes 537, with at least one of the outer edges 538A-B of the connecting portion 538 having a concave profile. In the embodiment shown in FIGS. 32-36, both the inner and outer edges 533, 534 of the tapered area 532 define a peanut shape, with the upper and lower edges 538A-B of the connecting portion 538 having concave profiles. Because the inner edge 533 of the tapered area 532 forms the outer edge of the plateau area 531, the outer edge of the plateau area 531 also defines a peanut shape as described above. Further, either or both of the inner and outer edges 533, 534 of the tapered area 532 may be considered to define an elevated area 536 that has a greater face thickness than the surrounding areas of the face and has an outer edge defining a peanut shape as described above.

Additionally, in the embodiment illustrated in FIGS. 32-36, the shape(s) defined by the edges 533, 534 of the tapered area 532, including the shapes of the plateau area 531 and the elevated area 536, are elongated along an axis of elongation (which is elevated approximately 12° counterclockwise from horizontal in FIG. 34). In this embodiment, the lobes 537 each have dimensions measured along a second axis perpendicular to the axis of elongation (e.g. approximately 12° counterclockwise from vertical in FIG. 34), and the lobes 537 have greater dimensions perpendicular to the axis of elongation than the connecting area 538, which is narrowed with respect to the lobes 537. The angle of the axis of elongation in this embodiment may be based on typical hitting patterns for one or more golfers. In other embodiments, the thickened portion 530 may have a different orientation and/or axis of elongation based on a different hitting pattern and/or other factors, and different clubs in a set may have thickened portions 530 with different axes of elongation based on different hitting patterns for each club. For example, in one embodiment, a set of golf irons may have structures as described herein and shown in FIGS. 32-36, and the angle of the axis of elongation of the thickened portion 530 may be closer to horizontal for shorter (i.e. more lofted) clubs and farther from horizontal for longer (i.e. less lofted) clubs in the set. The angle of the axis of elongation may be between 0-15° or 0-18° from horizontal in various embodiments.

In one embodiment of the face 512 illustrated in FIGS. 32-36, the plateau area 531 has a generally constant thickness of approximately 3 mm, and the peripheral area 535 has a generally constant thickness of approximately 2 mm. In an alternate embodiment, where the plateau area 531 and/or the peripheral area do not have a generally constant thickness, the maximum thickness of the plateau area 531 is approximately 3 mm, and the minimum thickness of the peripheral area 535 is approximately 2 mm. As described above, in other embodiments, the face 512 and the thickened portion 530 may have different thicknesses. It is understood that in one embodiment, the thicknesses of these various portions of the face 512 may be increased or decreased, while maintaining the same or approximately the same relative differences in thickness, either as a proportion or an absolute difference.

The heads 102, et seq., as shown and described herein may be constructed from a wide variety of different materials, including materials conventionally known and used in the art, such as steel, titanium, aluminum, tungsten, graphite, polymers, or composites, or combinations thereof. Also, if desired, the club heads 102, et seq., may be made from any number of pieces (e.g., having a separate face plate, etc.) and/or by any construction technique, including, for example, casting, forging, welding, and/or other methods known and used in the art. More specific examples of such materials that may be used to form faces 112, et seq., or face members 128, et seq., as described herein include those described above, including high strength stainless steels such as C455 and C465, other stainless steels such as 17-4, other steels such as maraging steels (e.g. Maraging 250) or AerMet steels, high strength titanium alloys such as 6-4, SP700, 8-1-1, 15-3-3-3, and 2041, PEEK polymer with or without fiber reinforcement, amorphous "liquid metal" alloys, bulk modulus composites, etc. High strength alloys and other materials may have yield strengths of approximately 230-240 ksi or greater and ultimate strengths of approximately 250-260 ksi or greater. In one embodiment, the face 312, 412 of a fairway wood or hybrid-type club may be made from C465 alloy that is aged at 482° C. for 4 hours, to achieve a yield strength of at least 240 ksi and a UTS of at least 260 ksi. In another embodiment, the face 112, 212 of a driver wood-type club may be made from a high strength titanium alloy (e.g. 6-4) that may be aged at 482° C. for 6-8 hours and/or annealed, and may have a yield strength of approximately 120-150 ksi or greater and an ultimate strength of approximately 130-165 or greater. In a further embodiment, the face 112, 212 of a driver wood-type club may be made from a 15-3-3-3 titanium alloy that may be aged at 480° C. for 2-14 hours, and may have a yield strength of approximately 145-181 ksi or greater and an ultimate strength of approximately 165-200 ksi or greater.

It is understood that any of the embodiments of ball striking devices 100, et seq., heads 102, et seq., faces 112, et seq., and other components described herein may include any of the features described herein with respect to other embodiments described herein, unless otherwise noted. It is understood that the specific sizes, shapes, orientations, and locations of various components of the ball striking devices 100, et seq., and heads 102, et seq., described herein are simply examples, and that any of these features or properties may be altered in other embodiments.

The desired shapes, orientations, configurations, etc., of the thickened portions 130, et seq., illustrated in FIGS. 1-36 can be influenced by typical or common locations where face impacts occur during many golfers' swings, face geometry and properties, body features such as a channel 240, and other features affecting or influencing the impact physics of the face 112, et seq. For example, many golfers tend to hit balls on the low-heel or high-toe areas of the face 112, et seq., on missed hits, and the orientation (e.g. angle of axis of elongation) of the thickened portion 130, et seq., may reflect that pattern. In further embodiments, the shapes of the thickened portions 130, et seq., can be altered to achieve different impact physics, or to account for changes to other portions of the club head 102, et seq. Finite element analysis may be used in connection with designing the geometry of the thickened portion 130, et seq., and/or other portions of the face 112, et seq., which may incorporate any of the factors referenced above or additional factors.

Heads 102, et seq., incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head according to one or more embodiments described herein. Such a set may include at least one wood-type club and/or at least one iron-type club. For example, a set of iron-type golf clubs can be provided, with each club having a different loft angle, and each club having a head as described above. The various clubs in the set may have thickened portions 130, et seq., that may be slightly different in shape, size, location, orientation, etc., based on the loft angle of the club. Further, one or more clubs can be customized for a particular user by providing a club with a head as described above, with a thickened portion 130, et seq., that is configured in at least one of its shape, size, location, orientation, etc., based on a typical hitting pattern by the golfer. Still further embodiments and variations are possible, including further techniques for customization.

The shapes of the thickened portions 130, et seq., and the various components of the thickened portions 130, et seq., described herein can increase energy transfer and impact velocity for impacts between the ball striking surface 110, et seq., and a ball, such as a golf ball. The thickened portion 130, et seq., creates a stiffened center portion of the face, which permits other areas of the face 112, et seq., to be more flexible (such as by decreasing the thickness), creating a more gradual impact with the ball, which in turn can decrease overall ball deformation. Because significant energy loss can occur with excessive ball deformation, the configuration of the face 112, et seq., can result in less energy loss and greater energy and velocity upon impact. In embodiments where the head 202, et seq., includes a channel 240, et seq., the channel 240, et seq., can flex during impact to work with the face 212, et seq., to reduce ball deformation and thereby increase energy and velocity on impact. In one embodiment, the flexing of the channel 240, et seq., may occur subsequent to the flexing of the face 112, et seq., and may have a smaller effect on ball deformation as compared to the face 112, et seq. Additionally, the stiffened center portion and more flexible peripheral portions increase the trampoline effect of the face 112, et seq., and increase the size of the "hot zone" having high response (e.g. COR), to improve ball speed on off-center hits, while enabling the face 112, et seq., to still meet applicable USGA regulations. The thickened portion 130, et seq., also adds durability to the center of the face 112, et seq., and the surrounding areas, which can increase the usable life of the face. Still further benefits can be recognized and appreciated by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face having a striking surface configured for striking a ball, an inner surface opposite the striking surface, and a face thickness defined between the striking surface and the inner surface, the face further having a geometric center and peripheral edges;

a body connected to the peripheral edges of the face and extending rearwardly from the face, the body having a crown, a sole, a heel, and a toe;

wherein the face comprises a thickened portion that forms a protrusion extending rearwardly from the inner surface of the face, the thickened portion comprising an annular tapered area that tapers in thickness between an upper boundary and a lower boundary and encloses an elevated area bounded by the upper boundary, wherein at least one of the upper and lower boundaries defines a shape comprising a first lobe on a heel side of the thickened portion having a first outer edge with a convex outer profile, a second lobe on a toe side of the thickened portion having a second outer edge with a convex outer profile, and a connecting portion extending between the first lobe and the second lobe, wherein the shape is elongated to have a maximum dimension along a first axis, and wherein the first lobe has a first dimension along a second axis perpendicular to the first axis, the second lobe has a second dimension along the second axis, and the connecting portion has a third dimension along the second axis that is smaller than the first and second dimensions, and wherein the first dimension is larger than the second dimension, such that the connecting portion is defined by third and fourth outer edges on crown and sole sides of the thickened portion, respectively, the third and fourth outer edges extending in a heel-to-toe direction between the first and second outer edges, wherein at least the third outer edge has a concave profile;

wherein the elevated area is multi-tiered and comprises a first plateau area having a first generally constant face thickness, a second plateau area having a second generally constant face thickness, and a tapered area extending between the first and second plateau areas and further consisting of a single elongated channel extending across the sole of the body spaced rearwardly from a bottom peripheral edge of the face, wherein the single elongated channel is recessed from adjacent portions of the body.

2. The golf club head of claim 1, wherein the single elongated channel comprises two boundary edges extending generally parallel to the bottom peripheral edge of the face and two walls extending inwardly into the body from the boundary edges to form a recessed trough, and wherein the channel extends across a front-to-rear geometric centerline of the sole.

3. The golf club head of claim 2, wherein the recessed trough has a curvilinear cross sectional shape.

4. The golf club head of claim 1, wherein the body has a thin-wall construction and an internal cavity, such that the single elongated channel is recessed and creates a raised area on an inner surface of the face that protrudes into the internal cavity.

5. The golf club head of claim 1, wherein the face thickness is greatest at an area surrounding the geometric center of the face and decreases to a smallest thickness at the peripheral edges.

6. The golf club head of claim 1, wherein the face thickness is greatest at the point proximate the geometric center of the face and decreases to a smallest thickness at the peripheral edges.

7. A golf club comprising the golf club head of claim 1 and a shaft connected to the golf club head and configured for gripping by a user.

8. The golf club head of claim 1, wherein a shape of the thickened portion includes a concave contour on both the crown side and the sole side of the thickened portion.

9. The golf club head of claim 1, wherein a shape of the thickened portion includes a concave contour on only the crown side of the thickened portion.

10. A golf club head comprising:

a face having a striking surface configured for striking a ball, an inner surface opposite the striking surface, and a face thickness defined between the striking surface and the inner surface, the face further having a geometric center and peripheral edges; a body connected to the peripheral edges of the face and extending rearwardly from the face, the body having a crown, a sole, a heel, and a toe;

wherein the face comprises a thickened portion that forms a protrusion extending rearwardly from the inner surface of the face, the thickened portion comprising an annular tapered area that tapers in thickness between an upper boundary and a lower boundary and encloses an elevated area bounded by the upper boundary, wherein at least one of the upper and lower boundaries defines a shape comprising a first lobe on a heel side of the thickened portion having a first outer edge with a convex outer profile, a second lobe on a toe side of the thickened portion having a second outer edge with a convex outer profile, and a connecting portion extending between the first lobe and the second lobe, such that the connecting portion is defined by third and fourth outer edges on a crown and sole sides of the thickened portion, respectively, wherein the shape is elongated to have a maximum dimension along a first axis, and wherein the first lobe has a first dimension along a second axis perpendicular to the first axis, the second lobe has a second dimension along the second axis, and the connecting portion has a third dimension along the second axis that is smaller than the first and second dimensions, and wherein the second dimension is larger than the first dimension, the third and fourth outer edges extending in a heel-to-toe direction between the first and second outer edges, wherein the elevated area is multi-tiered and comprises a first plateau area having a first generally constant face thickness, a second plateau area having a second generally constant face thickness, and a tapered area extending between the first and second plateau areas; and wherein the thickened portion of the face has a shape that is elongated in a heel-to-toe direction and includes a concave contour at least on a crown side of the thickened portion;

further consisting of a single elongated channel extending across the sole of the body and being spaced rearwardly from a bottom peripheral edge of the face, wherein the single elongated channel is recessed from adjacent portions of the body.

11. The golf club head of claim 10, wherein the thickened portion creates a greater face thickness proximate the geometric center of the face compared to the peripheral edges.

12. The golf club head of claim 10, wherein the single elongated channel comprises two boundary edges extending generally parallel to the bottom edge of the face and two walls extending inwardly into the body from the boundary edges to form a recessed trough, and wherein the single elongated channel extends across a front-to-rear geometric centerline of the sole.

13. The golf club head of claim 12, wherein the recessed trough has a curvilinear cross sectional shape.

14. The golf club head of claim 10, wherein the body has a thin-wall construction and an internal cavity, such that the single elongated channel is recessed and creates a raised area on an inner surface of the face that protrudes into the internal cavity.

15. The golf club head of claim 10, wherein the face thickness is greatest at the thickened portion and decreases to a smallest thickness at the peripheral edges.

16. A golf club comprising the golf club head of claim 10 and a shaft connected to the golf club head and configured for gripping by a user.

17. The golf club head of claim 10, wherein the shape of the thickened portion includes the concave contour on both the crown side and the sole side of the thickened portion.

18. The golf club head of claim 10, wherein the shape of the thickened portion includes the concave contour on only the crown side of the thickened portion.

19. A golf club head comprising:

a face having a striking surface configured for striking a ball, an inner surface opposite the striking surface, and a face thickness defined between the striking surface and the inner surface, a body connected to peripheral edges of the face and extending rearwardly from the face, the body having a crown, a sole, a heel, and a toe, the body further combining with the face to define an internal cavity;

wherein the face comprises a thickened portion that forms a protrusion extending rearwardly from the inner surface of the face, the thickened portion comprising an annular tapered area that tapers in thickness between an upper boundary and a lower boundary and encloses an elevated area bounded by the upper boundary, wherein at least one of the upper and lower boundaries defines a shape comprising a first lobe on a heel side of the thickened portion having a first outer edge with a convex outer profile, a second lobe on a toe side of the thickened portion having a second outer edge with a convex outer profile, and a connecting portion extending between the first lobe and the second lobe, wherein the shape is elongated to have a maximum dimension along a first axis, and wherein the first lobe has a first dimension along a second axis perpendicular to the first axis, the second lobe has a second dimension along the second axis, and the connecting portion has a third dimension along the second axis that is smaller than the first and second dimensions, and wherein the first dimension is larger than the second dimension, such that the connecting portion is defined by third and fourth outer edges on crown and sole sides of the thickened portion, respectively, the third and fourth outer edges extending in a heel-to-toe direction between the first and second outer edges, wherein at least the third outer edge has a concave profile;

wherein the elevated area is multi-tiered and comprises a first plateau area having a first generally constant face thickness, a second plateau area having a second generally constant face thickness, and a tapered area extending between the first and second plateau areas; and further consisting of a single elongated channel extending across the sole of the body and being spaced rearwardly from a bottom peripheral edge of the face, wherein the single elongated channel has a front edge, a rear edge, and an inwardly recessed trough between the front and rear edges, wherein the body has a thin-wall construction, such that the single elongated channel creates a raised area on an inner surface of the face that protrudes into the internal cavity.

20. The golf club head of claim 19, wherein the inwardly recessed trough has a curvilinear cross sectional shape.

21. The golf club head of claim 19, wherein the face thickness is greatest at an area surrounding the geometric center of the face and decreases to a smallest thickness at the peripheral edges.

22. A golf club comprising the golf club head of claim 19 and a shaft connected to the golf club head and configured for gripping by a user.

23. The golf club head of claim 19, wherein the single elongated channel extends across a front-to-rear geometric centerline of the sole.

* * * * *